US010179078B2

(12) United States Patent
Bhugra et al.

(10) Patent No.: US 10,179,078 B2
(45) Date of Patent: Jan. 15, 2019

(54) THERAPEUTIC METHOD AND DEVICE FOR REHABILITATION

(71) Applicant: AlterG, Inc., Fremont, CA (US)

(72) Inventors: Kern S. Bhugra, San Jose, CA (US); Robert W. Horst, San Jose, CA (US); Robert L. Jardine, Cupertino, CA (US)

(73) Assignee: AlterG, Inc., Fremont, CA (US)

( * ) Notice: Subject to any disclaimer, the term of this patent is extended or adjusted under 35 U.S.C. 154(b) by 556 days.

(21) Appl. No.: 13/912,122

(22) Filed: Jun. 6, 2013

(65) Prior Publication Data

US 2013/0345601 A1 Dec. 26, 2013

Related U.S. Application Data

(62) Division of application No. 12/134,095, filed on Jun. 5, 2008, now abandoned.

(51) Int. Cl.
*A61H 1/00* (2006.01)
*A61H 1/02* (2006.01)
(Continued)

(52) U.S. Cl.
CPC ..... *A61H 1/008* (2013.01); *A61H 1/024* (2013.01); *A61H 1/0266* (2013.01);
(Continued)

(58) Field of Classification Search
CPC ..... A61H 1/008; A61H 1/024; A61H 1/0266; A61H 2201/165; A61H 2201/5064;
(Continued)

(56) References Cited

U.S. PATENT DOCUMENTS 1,286,482 A 12/1918 Yoder
1,366,904 A 2/1921 Davis
(Continued)

FOREIGN PATENT DOCUMENTS

EP 1138286 A2 10/2001
EP 1410780 A1 4/2004
(Continued)

OTHER PUBLICATIONS

Smith et at.; U.S. Appl. No. 14/325,935 entitled "Multi-fit orthotic and mobility assistance apparatus," filed Jul. 8, 2014.
(Continued)

*Primary Examiner* — Quang D Thanh
(74) *Attorney, Agent, or Firm* — Shay Glenn LLP

(57) ABSTRACT

The invention relates to embodiments of methods for extending a subject-controllable range of joint motion, and for increasing subject control of joint movement within a range of motion. Embodiments include fastening a powered device around a joint so as to be able to control the joint, allowing the subject to move the joint within a range of volitional motion, and then engaging the powered device to support movement of the joint into an expanded, rehabilitative range. In some embodiments, the device supports joint movement by substantially providing the force to move the joint beyond the volitional boundary. In other embodiments, supporting movement includes the subject substantially providing the force, and the device allowing movement only in a desired direction. The invention further relates to a system for increasing the functional capability of a joint by implementing embodiments of the method. By such methods and system, rehabilitation is accomplished both by building strength, and training neural pathways.

23 Claims, 12 Drawing Sheets

(51) Int. Cl.
*A63B 21/00* (2006.01)
*A63B 21/005* (2006.01)

(52) U.S. Cl.
CPC .... *A63B 21/0054* (2015.10); *A63B 21/00181* (2013.01); *A61H 2201/165* (2013.01); *A61H 2201/5015* (2013.01); *A61H 2201/5038* (2013.01); *A61H 2201/5061* (2013.01); *A61H 2201/5064* (2013.01); *A61H 2201/5069* (2013.01); *A61H 2230/65* (2013.01)

(58) Field of Classification Search
CPC .... A61H 2201/5069; A61H 2201/5061; A61H 2201/5015; A61H 2201/5038; A61H 2230/65; A63B 21/0054; A63B 21/00181
See application file for complete search history.

(56) References Cited

U.S. PATENT DOCUMENTS 1,391,290 A 9/1921 Welffens
1,513,473 A 10/1924 Ackerman
1,739,053 A 12/1929 Wilhelm
1,847,720 A 3/1932 Marcellis
2,169,813 A 8/1939 Parkin
3,059,490 A 10/1962 McDuffie
3,200,666 A 8/1965 Schrodt et al.
3,358,678 A 12/1967 Kultsar
3,398,248 A 8/1968 Klauss et al.
3,402,942 A 9/1968 Shimano et al.
3,631,542 A 1/1972 Potter
3,641,843 A 2/1972 Lemmens
3,863,512 A 2/1975 Crawley
3,899,383 A 8/1975 Schultz et al.
3,925,131 A 12/1975 Krause
3,976,057 A 8/1976 Barclay
4,273,113 A 6/1981 Hofstein
4,474,176 A 10/1984 Farris et al.
4,507,104 A 3/1985 Clark et al.
4,538,595 A 9/1985 Hajianpour
4,549,555 A 10/1985 Fraser et al.
4,588,040 A 5/1986 Albright, Jr. et al.
4,647,918 A 3/1987 Goforth
4,649,488 A 3/1987 Osanai et al.
4,665,899 A 5/1987 Farris et al.
4,678,354 A 7/1987 Olsen
4,679,548 A 7/1987 Pecheux
4,691,694 A 9/1987 Boyd et al.
4,697,808 A 10/1987 Larson et al.
4,731,044 A 3/1988 Mott
4,745,930 A 5/1988 Confer
4,754,185 A 6/1988 Gabriel et al.
4,796,631 A 1/1989 Grigoryev
4,801,138 A 1/1989 Airy et al.
4,807,874 A 2/1989 Little
4,814,661 A 3/1989 Ratzlaff et al.
4,825,852 A 5/1989 Genovese et al.
4,872,665 A 10/1989 Chareire
4,878,663 A 11/1989 Luquette
4,883,445 A 11/1989 Gomoll et al.
4,922,925 A 5/1990 Crandall et al.
4,934,694 A 6/1990 McIntosh
4,944,713 A 7/1990 Salerno
4,953,543 A 9/1990 Grim et al.
4,981,116 A 1/1991 Trinquard
4,983,146 A 1/1991 Charles et al.
5,020,790 A 6/1991 Beard et al.
5,046,375 A 9/1991 Salisbury et al.
5,052,681 A 10/1991 Williams
5,078,152 A 1/1992 Bond et al.
5,117,814 A 6/1992 Luttrell et al.
5,170,776 A 12/1992 Pecheux
5,170,777 A 12/1992 Reddy et al.
5,195,617 A 3/1993 Clemens
5,203,321 A 4/1993 Donovan et al.
5,209,223 A 5/1993 McGorry et al.
5,213,094 A 5/1993 Bonutti
5,239,222 A 8/1993 Higuchi et al.
5,241,952 A 9/1993 Ortiz
5,282,460 A 2/1994 Boldt
5,303,716 A 4/1994 Mason et al.
5,313,968 A 5/1994 Logan et al.
5,345,834 A 9/1994 Hayashi
5,358,468 A 10/1994 Longo et al.
5,378,954 A 1/1995 Higuchi et al.
5,395,303 A 3/1995 Bonutti et al.
5,399,147 A 3/1995 Kaiser
5,410,488 A 4/1995 Andersen
5,421,798 A 6/1995 Bond et al.
5,440,945 A 8/1995 Penn
5,448,124 A 9/1995 Higuchi et al.
5,463,526 A 10/1995 Mundt
5,476,441 A 12/1995 Durfee et al.
5,509,894 A 4/1996 Mason et al.
5,520,627 A 5/1996 Malewicz
5,525,642 A 6/1996 Cipriano et al.
5,534,740 A 7/1996 Higuchi et al.
5,541,465 A 7/1996 Higuchi et al.
5,573,088 A 11/1996 Daniels
5,582,579 A 12/1996 Chism et al.
5,585,683 A 12/1996 Higuchi et al.
5,608,599 A 3/1997 Goldman
5,624,390 A 4/1997 Van Dyne
5,653,680 A 8/1997 Cruz
5,662,594 A 9/1997 Rosenblatt
5,662,693 A 9/1997 Johnson et al.
5,674,262 A 10/1997 Tumey
5,678,448 A 10/1997 Fullen et al.
5,683,351 A 11/1997 Kaiser et al.
5,695,859 A 12/1997 Burgess
5,704,440 A 1/1998 Urban et al.
5,708,319 A 1/1998 Ban et al.
5,728,017 A 3/1998 Bellio et al.
5,746,684 A 5/1998 Jordan
5,746,704 A 5/1998 Schenck et al.
5,755,303 A 5/1998 Yamamoto et al.
5,789,843 A 8/1998 Higuchi et al.
5,833,257 A 11/1998 Kohlheb et al.
5,865,770 A 2/1999 Schectman
5,916,689 A 6/1999 Collins et al.
5,931,756 A 8/1999 Ohsono et al.
5,976,063 A 11/1999 Joutras et al.
6,001,075 A 12/1999 Clemens et al.
6,030,351 A 2/2000 Schmidt et al.
6,033,330 A 3/2000 Wong et al.
6,033,370 A 3/2000 Reinbold et al.
6,062,096 A 5/2000 Lester
6,119,539 A 9/2000 Papanicolaou
6,146,341 A 11/2000 Sato et al.
6,149,612 A 11/2000 Schnapp et al.
6,162,189 A 12/2000 Girone et al.
6,183,431 B1 2/2001 Gach, Jr.
6,217,532 B1 4/2001 Blanchard et al.
6,221,032 B1 4/2001 Blanchard et al.
6,290,662 B1 9/2001 Morris et al.
6,314,835 B1 11/2001 Lascelles et al.
6,375,619 B1 4/2002 Ohdachi
6,387,066 B1 5/2002 Whiteside
6,440,093 B1 8/2002 McEwen et al.
6,472,795 B2 10/2002 Hirose et al.
6,494,798 B1 12/2002 Onogi
6,500,138 B1 12/2002 Irby et al.
6,517,503 B1 2/2003 Naft et al.
6,525,446 B1 2/2003 Yasuda et al.
6,527,671 B2 3/2003 Paalasmaa et al.
6,533,742 B1 3/2003 Gach, Jr.
6,537,175 B1 3/2003 Blood
6,554,773 B1 4/2003 Nissila et al.
6,572,558 B2 6/2003 Masakov et al.
6,599,255 B2 7/2003 Zhang
6,659,910 B2 12/2003 Gu et al.
6,666,796 B1 12/2003 MacCready, Jr.
6,689,075 B2 2/2004 West
6,694,833 B2 2/2004 Hoehn et al.

(56) References Cited

U.S. PATENT DOCUMENTS 6,709,411 B1 3/2004 Olinger
6,796,926 B2 9/2004 Reinkensmeyer et al.
6,805,677 B2 10/2004 Simmons
6,821,262 B1 11/2004 Muse et al.
6,827,579 B2 12/2004 Burdea et al.
6,836,744 B1 12/2004 Asphahani et al.
6,872,187 B1 3/2005 Stark et al.
6,878,122 B2 4/2005 Cordo
6,936,994 B1 8/2005 Gimlan
6,966,882 B2 11/2005 Horst
7,041,069 B2 5/2006 West
7,124,321 B2 10/2006 Garnett et al.
7,137,938 B2 11/2006 Gottlieb
7,171,331 B2 1/2007 Vock et al.
7,190,141 B1 3/2007 Ashrafiuon et al.
7,192,401 B2 3/2007 Saalasti et al.
7,217,247 B2 5/2007 Dariush et al.
7,239,065 B2 7/2007 Horst
7,252,644 B2 8/2007 Dewald et al.
7,309,320 B2 12/2007 Schmehl
7,324,841 B2 1/2008 Reho et al.
7,365,463 B2 4/2008 Horst et al.
7,367,958 B2 5/2008 McBean et al.
7,410,471 B1 8/2008 Campbell et al.
7,416,537 B1 8/2008 Stark et al.
7,431,707 B2 10/2008 Ikeuchi
7,457,724 B2 11/2008 Vock et al.
7,458,922 B2 12/2008 Pisciottano
7,537,573 B2 5/2009 Horst
7,559,909 B2 7/2009 Katoh et al.
7,578,799 B2 8/2009 Thorsteinsson et al.
7,648,436 B2 1/2010 Horst et al.
7,731,670 B2 6/2010 Aguirre-Ollinger et al.
7,833,178 B2 11/2010 Lee et al.
7,880,345 B2 2/2011 Hoffmann et al.
7,998,092 B2 8/2011 Avni et al.
8,052,629 B2 11/2011 Smith et al.
8,058,823 B2 11/2011 Horst et al.
8,167,829 B2 5/2012 Sterling et al.
8,274,244 B2 9/2012 Horst et al.
8,353,854 B2 1/2013 Horst et al.
2001/0029343 A1 10/2001 Seto et al.
2002/0029911 A1 3/2002 Richards
2002/0128552 A1 9/2002 Nowlin et al.
2003/0104886 A1 6/2003 Gajewski
2003/0120183 A1 6/2003 Simmons
2003/0184310 A1 10/2003 Lurtz
2003/0195638 A1 10/2003 Kajitani et al.
2003/0212356 A1 11/2003 Scorvo
2004/0015112 A1 1/2004 Salutterback et al.
2004/0049139 A1 3/2004 Craciunescu
2004/0054311 A1 3/2004 Sterling
2004/0078091 A1 4/2004 Elkins
2004/0102723 A1* 5/2004 Horst ..... A61H 1/0237 601/5
2004/0106881 A1 6/2004 McBean et al.
2004/0215111 A1 10/2004 Bonutti et al.
2005/0014600 A1 1/2005 Clauson
2005/0085346 A1 4/2005 Johnson
2005/0085353 A1 4/2005 Johnson
2005/0101887 A1 5/2005 Stark et al.
2005/0151420 A1 7/2005 Crombez et al.
2005/0173994 A1 8/2005 Pfister et al.
2005/0210557 A1 9/2005 Falconer
2005/0221926 A1 10/2005 Naude
2005/0245849 A1 11/2005 Cordo
2005/0251067 A1 11/2005 Terry
2005/0253675 A1 11/2005 Davison
2005/0273022 A1 12/2005 Diaz et al.
2006/0004265 A1 1/2006 Pulkkinen et al.
2006/0046907 A1 3/2006 Rastegar et al.
2006/0069336 A1 3/2006 Krebs et al.
2006/0108954 A1 5/2006 Sebille et al.
2006/0132069 A1 6/2006 Hemphill et al.
2006/0157010 A1 7/2006 Moriwaki et al.
2006/0206045 A1 9/2006 Townsend et al.
2006/0249315 A1 11/2006 Herr et al.
2006/0251179 A1 11/2006 Ghoshal
2006/0293624 A1 12/2006 Enzerink et al.
2007/0015611 A1 1/2007 Noble et al.
2007/0038161 A1* 2/2007 Bonutti ..... A61F 5/0102 601/5
2007/0055163 A1 3/2007 Asada et al.
2007/0093729 A1 4/2007 Ewing
2007/0105695 A1 5/2007 Susta
2007/0149899 A1 6/2007 Shechtman et al.
2007/0155557 A1 7/2007 Horst et al.
2007/0155558 A1 7/2007 Horst et al.
2007/0155560 A1 7/2007 Horst et al.
2007/0155588 A1 7/2007 Stark et al.
2007/0162152 A1 7/2007 Herr et al.
2007/0173747 A1 7/2007 Knotts
2007/0225620 A1 9/2007 Carignan et al.
2007/0248799 A1 10/2007 DeAngelis et al.
2007/0265534 A1 11/2007 Martikka et al.
2007/0270265 A1 11/2007 Miller et al.
2007/0287302 A1 12/2007 Lindberg et al.
2007/0287928 A1 12/2007 Kiviniemi et al.
2008/0039731 A1 2/2008 McCombie et al.
2008/0097269 A1 4/2008 Weinberg et al.
2008/0152463 A1 6/2008 Chidambaram et al.
2008/0177208 A1 7/2008 Borschneck
2008/0195005 A1* 8/2008 Horst ..... A61H 1/0218 601/22
2008/0200994 A1 8/2008 Colgate et al.
2008/0234608 A1 9/2008 Sankai
2008/0281436 A1 11/2008 Townsend et al.
2009/0007983 A1 1/2009 Healy
2009/0030530 A1 1/2009 Martin
2009/0036804 A1 2/2009 Horst
2009/0048686 A1 2/2009 Ikeuchi et al.
2009/0093353 A1* 4/2009 Weiner ..... A61H 1/024 482/130
2009/0131839 A1 5/2009 Yasuhara
2009/0171469 A1 7/2009 Thorsteinsson et al.
2009/0235739 A1 9/2009 Morris-Bamberg et al.
2009/0260426 A1 10/2009 Lieberman et al.
2009/0265018 A1 10/2009 Goldfarb et al.
2009/0306548 A1 12/2009 Bhugra et al.
2010/0049102 A1 2/2010 Yasuhara
2010/0114329 A1 5/2010 Casler et al.
2010/0211355 A1 8/2010 Horst et al.
2010/0224844 A1 9/2010 Boussaton et al.
2010/0234775 A1 9/2010 Yasuhara et al.
2010/0280628 A1 11/2010 Sankai
2010/0318006 A1 12/2010 Horst
2011/0015498 A1 1/2011 Mestrovic et al.
2012/0053498 A1 3/2012 Horst
2012/0095377 A1 4/2012 Smith et al.
2012/0316475 A1 12/2012 Bhugra et al.
2013/0079687 A1 3/2013 Horst et al.
2013/0165817 A1 6/2013 Horst et al.
2015/0374573 A1 12/2015 Horst et al.
2017/0367918 A1 12/2017 Horst et al.

FOREIGN PATENT DOCUMENTS

JP 63-136978 A 6/1988
JP 02-275162 A 11/1990
JP 04-104180 A 4/1992
JP 05-038948 A 2/1993
JP 05-260766 10/1993
JP 06-038551 A 2/1994
JP 07-274540 A 10/1995
JP 08-033360 A 2/1996
JP 08-149858 6/1996
JP 08-154304 A 6/1996
JP 09-133196 A 5/1997
JP 09-261975 A 10/1997
JP 2001-353675 A 12/2001
JP 2002-191654 A 7/2002
WO WO 90/11049 A1 10/1990
WO WO 03/088865 A2 10/2003

(56) References Cited

FOREIGN PATENT DOCUMENTS

| | | | |
|---|---|---|---|
| WO | WO 2005/057054 | A1 | 6/2005 |
| WO | WO 2007/027673 | A2 | 3/2007 |
| WO | WO 2007/041303 | A2 | 4/2007 |

OTHER PUBLICATIONS

Horst et al.; U.S. Appl. No. 14/932,796 entitled "Multi-mode active orthotic sensor," filed Nov. 4, 2015.
Horst et al.; U.S. Appl. No. 14/162,553 entitled "Food pad device and method of obtaining weight data," filed Jan. 23, 2014.
Horst, R.; U.S. Appl. No. 14/225,186 entitled "Intention-based therapy device and method," filed Mar. 25, 2014.
Advanced Mechatronics Lab (Univ. of Tokyo); Dual Excitation Multiphase Electrostatic Drive (DEMED); http://www.intellect.pe.u-tokyo.ac.jp/research/es_motor/demed_e.html; pp. 1-5; (printed) Nov. 21, 2002.
Advanced Mechatronics Lab (Univ. of Tokyo); High-power electrostatic motor; http://www.intellect.pe.u-tokyo.ac.jp/research/es_motor/es_motor_e.html; pp. 1-2; (printed) Nov. 21, 2002.
Advanced Mechatronics Lab (Univ. of Tokyo); Pulse driven induction electrostatic motor; http://www.intellect.pe.u-tokyo.ac.jp/research/es_motor/pim_e.html;pp. 1-5; (printed) Nov. 21, 2002.
Asel (Univ. of Delaware); Powered orthosis project; http://www.asel.udel.edu/robotics/orthosis/orthosis.html, 1 pg.; (update) Jan. 17, 1999.
British Tech. Group; Demonstration of energy saving in vehicles by integrating an infinitely variable transmission with an optimized petrol engine; prj. No. TR/00087/92; pp. 1-19; (version) Jul. 15, 1998.
Coronel et al; The Coronel effect positively infinitely variable transmission; U.C. Davis; No. 04CVT-51; pp. 1-8; (year of pub. sufficiently earlier than effective US filing date and any foreign priority date) 2004.
Fitch, C. J.; Development of the electrostatic clutch; IBM Journal; pp. 49-56; Jan. 1957.
Frank, Andrew; Engine optimization concepts . . . ; U.C. Davis; No. 04CVT-56; pp. 1-12; (year of pub. sufficiently earlier than effective US filing date and any foreign priority date) 2004.
Gongola et al.; Design of a PZT-actuated proportional drum brake; IEEE ASME Trans. on Mech.; vol. 4; No. 4; pp. 409-416; Dec. 1999.
Howard Leitch, PPT Ltd.; Waveform Gearing; Motion System Design; pp. 33-35; Nov. 2002.
James et al.; Increasing power density in a full toroidal variator; 3rd Int'l. IIR-Symposium; Innovative Automotive Transmission; pp. 1-11; Dec. 2004.
Kawamoto et al.; Power assist system HAL-3 for GAIT disorder person; ICCHP 2002; LNCS 2398; pp. 196-203; Aug. 2002.
Kim et al.; On the energy efficiency of CVT-based mobile robots; Proc. 2000 IEEE; Int. Conf. on Robotics & Automation; pp. 1539-1544; San Francisco, CA; Apr. 2000.
Kluger et al.; An overview of current automatic, manual and continuously variable transmission efficiencies and their projected future improvements; Int. Congress and Expo. (No. 1999-1-1259); pp. 1-6; Detroit, MI; Mar. 1-4, 1999.
Krebs et al.; A paradigm shift for rehabilitation robotics; Eng. In Medicine and Biology Magazine, IEEE; vol. 27; Issue 4; pp. 61-70; Jul. 2008.
Misuraca et al.; Lower limb human enhancer; Int. Mech. Eng. Conf. and Expo.; New York, NY; pp. 1-7; Nov. 11-16, 2001.
Niino et al.; Electrostatic artificial muscle: compact, high-power linear actuators with multiple-layer structures; Proc. IEEE Workshop on Micro Electro Mechanical Systems; Oiso, Japan; pp. 130-135; Jan. 1994.
Nugent, James; Design and performance of an exponential roller gear . . . ; U.C. Davis; No. 04CVT-18; pp. 1-8; (year of pub. sufficiently earlier than effective US filing date and any foreign priority date) 2004.
Ohhashi, Toshio et al.; Human perspiration measurement; Physiological Measurement; vol. 19; pp. 449-461; Nov. 1998.
Otto Bock Health Care; (3C100 C-Leg® System) Creating a new standard for prosthetic control; http://www.ottobockus.com/products/op_lower_cleg.asp; pp. 1-2; (printed) Nov. 22, 2002.
Otto Bock Health Care; (3C100 C-Leg® System) New generation leg system revolutionizes lower limb prostheses; http://www.ottobockus.com/products/op_lower_cleg4.asp; pp. 1-2; (printed) Nov. 22, 2002.
Patras et al.; Electro-rheological fluids in the design of clutch systems for robotic applications; IEEE; pp. 554-558; Nov. 11-13, 1992.
Powell et al.; Computer model for a parallel hybrid electric vehicle (PHEV) with CVT; Proc. AACC; pp. 1011-1015; Chicago, IL; Jun. 2000.
Shastri et al.; Comparison of energy consumption and power losses of a conventionally controlled CVT with a servo-hydraulic controlled CVT and with a belt and chain as the torque transmitting element; U.C. Davis; No. 04CVT-55; pp. 1-11; Sep. 2004.
Shriner's Hospitals; Your new orthosis; http://www.shrinershq.org/patientedu/orthosis.html; pp. 1-3; (printed) Nov. 22, 2002.
Takaki et al; Load-sensitive continuously variable transmission for powerful and inexpensive robot hands; IEEE; pp. 45-46; Nov. 2004.
Takesue et al.; Development and experiments of actuator using MR fluid; IEEE; pp. 1838-1843; Oct. 2000.
Townsend Design; Functional Bracing Solutions (AIR Townsend & Ultra AIR); http://www.townsenddesign.com/air.html; 2 pgs; (printed) Nov. 21, 2002.
Townsend Design; Functional Knee Bracing Solutions; http://www.townsenddesign.com/functional.html; pp. 1; (printed) Nov. 21, 2002.
Townsend Design; Patented Motion Hinge (Planes of Motion); http://www.townsenddesign.com/motion.html; pp. 1; (printed) Nov. 21, 2002.
Trimmer et al.; An operational harmonic electrostatic motor; IEEE; pp. 13-16; Feb. 1989.
Smith et al., U.S. Appl. No. 12/471,299 entitled "Therapy and mobility assistance system," filed May 22, 2009.
Bhugra, Kern; U.S. Appl. No. 12/363,567 entitled "System and method for controlling the joint motion of a user based on a measured physiological property," filed Jan. 30, 2009.
Smith et al.; U.S. Appl. No. 13/907,490 entitled "Therapy and mobility assistance system," filed May 31, 2013.
Horst et al.; U.S. Appl. No. 15/273,525 entitled "Methods and devices for deep vein thrombosis prevention," filed Sep. 22, 2016.
Horst et al.; U.S. Appl. No. 15/893,493 entitled "Orthotic device drive system and method," filed Feb. 9, 2018.

* cited by examiner

THERAPEUTIC METHOD AND DEVICE FOR REHABILITATION

CROSS REFERENCE TO RELATED APPLICATION

This application is a divisional of U.S. patent application Ser. No. 12/134,095, filed Jun. 5, 2008, titled "THERAPEUTIC METHOD AND DEVICE FOR REHABILITATION," Publication No. US-2009-0306548-A1, which is herein incorporated by reference in its entirety.

FIELD OF THE INVENTION

The invention relates to the field of the functional rehabilitation of patients who have suffered loss of function due to injury, condition, or disease. For example, the method may be therapeutically applied by patients who have experienced a stroke.

INCORPORATION BY REFERENCE

All publications, patents and patent applications mentioned in this specification are herein incorporated by reference to the same extent as if each individual publication, patent or patent application was specifically and individually indicated to be incorporated by reference. The application, for example, incorporates in entirety by this reference U.S. Pat. No. 6,966,882, filed Nov. 6, 2003, of Robert Horst entitled "Active Muscle Assistance Device and Method" and U.S. Pat. No. 8,353,854, of Robert Horst, et al., entitled "Methods and Devices for Deep Vein Thrombosis Prevention," filed on Oct. 31, 2007.

BACKGROUND OF THE INVENTION

There is a need for devices that can assist individuals with impaired mobility resulting from injury, illness, or catastrophic events such as stroke. Mobility assistance is needed both in an immediate sense, assisting a subject with the physical abilities that he or she currently has, but also in a longer term sense, where a rehabilitation of muscles and neural pathways is desired for volitionally-instigated and controlled movement. Current assistive and rehabilitative devices variously include strength training devices, passive assistance and support devices, and active or powered mobility devices.

Strength training devices, their strength building benefits notwithstanding, provide little if any direct benefit toward mobility, nor do they provide joint support or muscle support or augmentation. In general, strength training enhances the strength of already functioning muscles and the robustness of functioning neural pathways. Passive assistance devices, such as canes, crutches, walkers and manual wheelchairs, can very effectively assist with mobility in an immediate sense, but they generally do not provide for rehabilitation or the development of unassisted mobility. As with strength training, the devices tend to rely on functioning muscle and existing neural pathways, without a particular benefit in terms of regaining lost independent or volitional function. Active or powered mobility devices, such as motorized wheelchairs, provide very valuable mobility benefits, but do little if anything in terms of encouraging the development of strength, or regaining independent functional mobility.

Passive support devices or orthoses (such as ankle, knee, elbow, cervical spine, thoracic spine, lumbar spine, hip, or other support braces) provide passive joint support and can serve as mobility aids and also provide support against injury. Manual braces with clutch-based knee hinges require the user to activate a brace lock mechanism in order to maintain a joint flexion or extension position; this aspect provides further supported functionality. These devices, as a whole, however, do not provide rehabilitation toward device-free independent mobility.

A number of newer and sophisticated microprocessor-enabled mobility assistance devices have been developed, many of which provide very helpful quality-of-life benefits to patients with compromised mobility. In general, however, the benefits of these devices are directed toward smarter forms of mobility assistance, not with the development of independent mobility.

There is a need to start closing the gap between the therapeutic contribution of support devices, both passive and active, as summarized above, and the benefits of therapy as can be provided, for example, personally, patiently, and intelligently, by physical therapists. What is needed are devices that can be directed intelligently toward rehabilitative muscle strengthening and neural pathway retraining, such as after a stroke, in order to serve both the immediate goal of supporting mobility and the longer term goal of independent, volitionally-instigated, and controlled movement. The present invention addresses these and related issues.

SUMMARY OF THE INVENTION

The invention relates to a method and a system for increasing the functional capability of joints, particularly in a rehabilitative sense, where the volitional range of motion of a patient may be improved, and where the effective control over joint movement within that range is increased. Rehabilitation of the functional capability of joints occurs through a number of physiological processes, including building of strength and retraining of neural pathways. Basically, the method includes fastening a powered device at sites above and below a joint of a subject so the device is able to control movement of the joint, the patient moving the joint volitionally within a range of motion substantially without assistance of the device, and then, moving the joint beyond that volitional range of motion substantially with the support of the device.

In some embodiments of the basic method just summarized, moving the joint volitionally includes moving the joint from a starting position to a volitional boundary of the subject's range of motion substantially through the effort of the subject; and moving the joint with the support of the powered device includes moving the joint beyond the volitional boundary with the assistance of the device. In some of these embodiments, moving the joint substantially without assistance of the device includes moving the joint solely through the effort of the subject. In other embodiments, moving the joint substantially without assistance of the device includes moving the joint with an amount of assistance from the device not exceeding the amount of force required to counter an effect of gravity that works against movement of the joint.

In other embodiments of the basic method just summarized, volitionally moving the joint includes moving the joint from a starting position in a direction toward the boundary of a range of motion, and moving the joint with the support of the powered device includes the device permitting movement only in that direction. Thus, in this embodiment, the device supports movement in a ratchet like manner.

In one aspect, the invention relates to a method for extending a subject-controllable range of motion of a joint; this method includes fastening a powered device at sites above and below at least one joint of a subject, moving a joint from a starting position to a volitional boundary of a subject's range of motion, substantially through the effort of the subject; and then moving the joint beyond that volitional boundary with the assistance of the powered device. In some embodiments, the moving beyond the volitional boundary includes moving to the boundary of an expanded a range of motion. This latter expanded range of motion may be understood as a rehabilitative range, movement through which may have the longer term therapeutic effect of expanding the patient's volitional range of motion. In some embodiments of the method, the position or dimensions of the expanded boundary are predetermined prior to the step of moving to it. Setting of the boundary may be done by a therapist, healthcare professional, or informed and capable subject inputting a boundary, or by the system making use of a formula or algorithm to generate a therapeutically appropriate boundary. As disclosed herein, embodiments of the method may be applied the ankles, knees, elbows, shoulder, hip, elbow, wrist, or other joints of the body. Boundaries of the volitional and expanded ranges of joint motion include the boundaries associated with both flexion and extension of the joint.

In some embodiments of the method, moving a joint to the volitional boundary is repeated one or more times prior to moving the joint to the expanded boundary of the rehabilitative range. As will be seen below, the movement within the subject's volitional range is sensed by the device, and repetition of this movement helps to better establish the volitional range boundary.

In some embodiments of the method, moving to the volitional boundary occurs substantially without assistance from the powered device, and is thus substantially under the control of the subject. In some particular embodiments of the method, moving to the volitional boundary may occur with a level of assistance from the powered device that counteracts at least a portion of gravitational force. In some embodiments of the method, the assistance in moving provided by the powered device includes the device permitting movement only in the direction of the expanded boundary in a ratchet-like manner, thus allowing the patient an opportunity to move the joint from an angle that is beyond the range where the joint would be volitionally.

In some embodiments, the method includes determining or sensing joint angle at time intervals while the joint is moving volitionally to determine if the joint has reached the volitional boundary of the joint's range of motion, and if the joint has not reached the volitional boundary before the lapse of a predetermined amount of time, then the method returns to the volitionally moving step.

In some embodiments, the method includes determining or sensing joint angle while the joint is moving volitionally to determine if the joint has reached the volitional boundary of the joint's of motion, and if the joint has not reached the boundary at a time after the lapse of a predetermined amount of time, then the method proceeds to the step of moving the joint with the assistance of the powered device. In some of these just recited embodiments, the method may further include decreasing the boundary of the volitional range, such decreased boundary being applied to the next cycle of the method.

In some embodiments, the method further includes determining joint angle while the joint is moving volitionally to determine if the joint has reached the volitional boundary of the joint's range of motion, and if the joint has reached the volitional boundary, then proceeding to the step of moving the joint with the assistance of the powered device.

In some embodiments, the method further includes determining joint angle while the joint is moving volitionally to determine if the joint has reached the volitional boundary of the joint's range of motion, and if the joint has reached the volitional boundary, then determining joint velocity, and if the velocity is greater than a preset limit, then continuing with the step of moving the joint volitionally.

In some embodiments, the method further includes determining joint angle while the joint is moving volitionally to determine if the joint has reached the boundary of the volitional range of motion, and if the joint has reached the volitional boundary, then determining joint velocity, and if the velocity is less than a preset limit, then proceeding to the step of moving the joint with the assistance of the powered device. In some of these just recited embodiments, the method may further include increasing the boundary of the volitional range, such increased boundary being applied to the next cycle of the method.

In some embodiments of the above summarized method, after moving beyond the boundary of the volitional range of either flexion or extension, the method may further include moving the joint to the boundary of an expanded range beyond the volitional boundary, and further moving the joint to the boundary of another expanded range, the other of flexion or extension. In some of these latter embodiments further includes moving the joint back to the position in which the joint started its movement. In these various embodiments, movement within the volitional boundaries of flexion and extension are substantially under the control of the patient, and movement beyond the volitional boundary and toward the boundary of the therapeutic range occurs with the assistance of the powered device.

The sum of the moving steps which originate and conclude at a starting position may be considered a movement cycle, and in various embodiments of the method, the cycle may be repeated one or more times. In some of these embodiments, the cycle may be repeated for a predetermined number of times, and it may be repeated at a predetermined rate of cycles per unit time.

In some embodiments of the method summarized above, the method includes sensing of the volitional boundary of the volitional movement of the joint. Structural aspects of sensing by a system for controlling movement are summarized below. Sensing may be provided by any one or more of joint angle sensor, a force sensor, a movement sensor, a current sensor, or a myoelectric sensor.

In a second aspect, the invention relates to a method for increasing a subject's control of movement of a joint within a range of motion from a start position towards a goal position. This embodiment includes fastening a powered device at sites above and below the joint, the powered device allowing volitional movement towards the goal position and resisting volitional movement away from the goal position.

Embodiments of the second aspect of the method include movement in both directions of flexion or extension, outward from a more central starting position, as for example, moving the joint volitionally to a peripheral position within the range of motion and moving the joint back to the start position, moving the joint volitionally to a peripheral position within a range of motion in the other direction of flexion or extension, and moving the joint to return back to the start position, the return marking the conclusion of a movement cycle. In various embodiments, the method may include repeating the movement cycle one or more times, repeating the cycle for a predetermined number of times, and/or repeating the cycle at a predetermined rate of cycles per unit time.

As summarized above in the first aspect of the method, the second aspect of the method may include providing some minimal assistance from the powered device in moving the joint even when the subject is substantially and volitionally moving the joint, the assistance counteracting at least a portion of gravitational force. Embodiments of this aspect of the method may be applied to various joints including the ankle, knee, hip, elbow or wrist The invention also includes a system that is able to operate the aspects and embodiments of the rehabilitative method summarized above. The system for increasing the functional capability of a patient's joint includes an actuator coupled to an orthotic device that is attached to both sides of a joint, at least one sensor adapted to determine an angle of the joint, and a controller operably connected to the actuator and the sensor. The actuator is configured to activate the orthotic to support movement of the joint, and the controller is configured to control the operation of the actuator, based on sensor input regarding the angle or position of the joint. Thus, when the patient's joint has reached a volitional boundary of extension or flexion, based on sensor input, the controller is configured to activate the actuator and thence the orthotic to support movement of the joint beyond the volitional boundary.

In some embodiments of the system, the controller is configured to differentiate the angle of the joint with respect to time, thereby being able to determine a rate of movement of a joint. Accordingly, these embodiments are able to determine when a joint is moving, and when it has come to a stop, the stop may indicate a boundary of volitional movement.

In some embodiments of the system, the controller is configured to operate the actuator and the orthotic in a mode that allows volitional movement of the joint to occur substantially without the assistance of the device, and the support provided to movement of the joint includes assistance in movement when the joint has moved to a boundary of volitional movement.

In some embodiments of the system, the controller is configured to operate the actuator and the orthotic in a mode that allows volitional movement of the joint to occur substantially without the assistance of the device when the joint is moving in a direction of either flexion or extension, and the support provided to movement of the joint includes permitting only that same respective direction of flexion or extension.

In various embodiments of the system, the controller is configured to activate the actuator to move the joint beyond the volitional boundary and then to the boundary of an expanded range of motion. In some embodiments, the controller is configured to have the actuator counteract at least in part the effect of gravity on movement of the joint even when the joint is substantially under the volitional control of the subject. And in some embodiments of the system, an actuator force sensor is operably connected to the controller and providing input thereto, the controller capable of limiting the maximal force applied to the actuator.

BRIEF DESCRIPTION OF THE DRAWINGS

FIG. 1 provides a diagram of the method as a whole.

FIG. 2 is a flow diagram that focuses on an assessment phase of the method, wherein a boundary of a volitional range of movement is determined.

FIG. 3 is a flow diagram that focuses on an assisting phase of the method, wherein a device provides support for movement beyond the volitional range.

FIG. 4 is a flow diagram that focuses on an embodiment of an assisting phase of the method, wherein a predetermined amount of time is allowed for volitional movement to the volitional movement boundary.

FIG. 5 is a flow diagram that focuses on an embodiment of an assisting phase of the method wherein the volitional boundary may be increased or decreased according to the performance of the subject, without returning to a formal assessment phase of the method.

FIG. 10A shows a frontal view of a foot in the device, FIG. 10B shows a side view of flexion of an ankle, and FIG. 10C shows a side view of extension of an ankle.

DETAILED DESCRIPTION OF THE INVENTION

Figure 1:
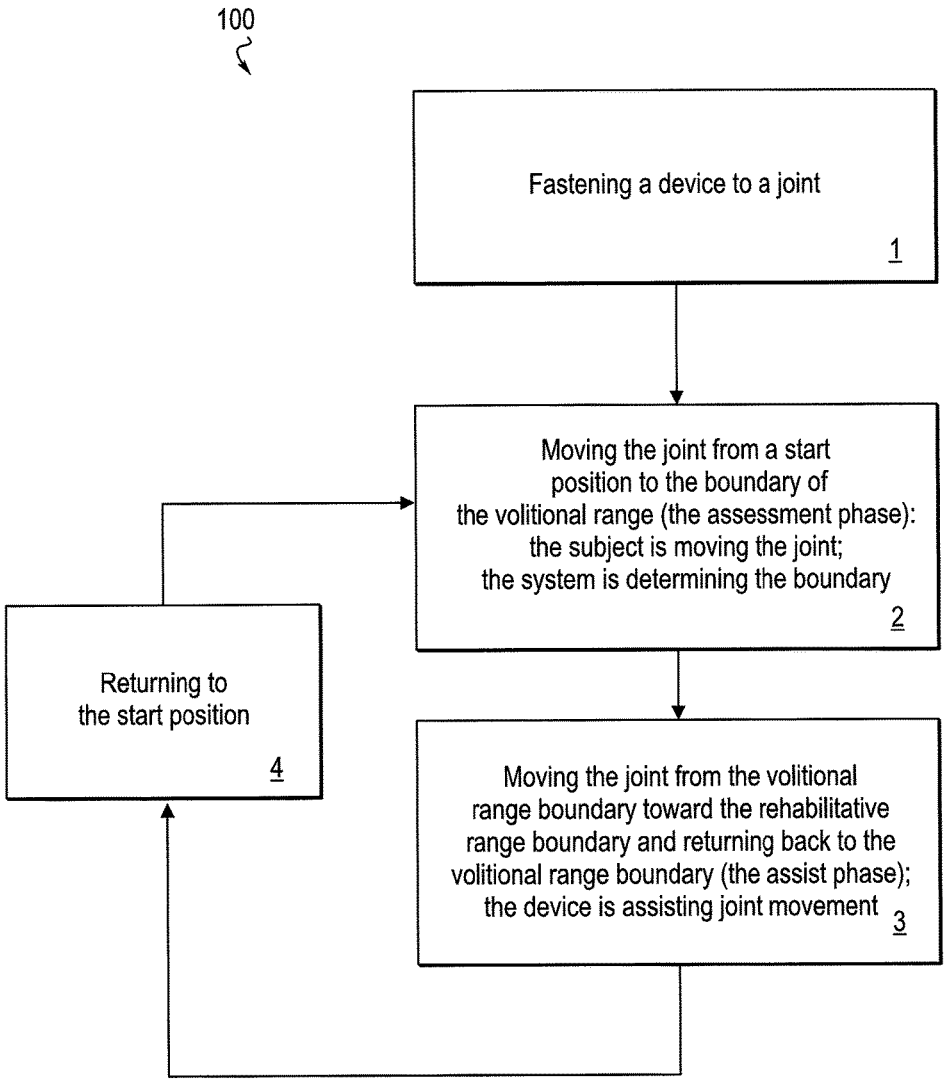
FIGS. 1-5 are flow diagrams of embodiments of the rehabilitative method.

Method of Extending the Range of Subject-Controllable Joint Motion

The invention provides therapeutic methods and a system for the rehabilitation of subjects who have suffered a loss or diminishment of their volitional range of motion and/or a loss of well-controlled joint function within their volitional range of motion, an object of the invention being the recovery of at least a portion of any aspect of such a loss of functional capability. A loss of joint mobility or control generally results in the diminishment of self-mobility of the patient, and this more generalized loss can have consequences that further erode joint-mobility and self-mobility. Increasing the functional capability of a joint, as provided by embodiments of the invention, has an immediate aspect, where mobility may be enhanced through support from embodiments of the inventive method and device, and it has a longer-term rehabilitative aspect, where the range of the patient's controlled volitional movement is improved or extended. Recovering volitional range of motion can require the strengthening of muscle, but more important, as in the case of a stroke, is the retraining of neural pathways that control the muscle. Embodiments of a system for such rehabilitative goals are described in sections below; the present section focuses on embodiments of the inventive method.

An object of the method is to expand a functional and controllable range of joint motion that has been compromised by injury or an adverse health condition. In many rehabilitative cases it is not the range of motion that a patient's joint may be passively put through that is so much the issue, but rather, it is the range of motion through which the patient can voluntarily exercise controlled movement, and the degree of control over the range of motion whether increased or not; the rehabilitative challenge is to increase the control within the volitional range of motion and to increase the volitional range of motion. Accordingly, embodiments of the method expect and encourage the patient to move a joint without assistance within the boundaries of the patient's current volitional range of motion, but then the method transitions smoothly into a different phase, and contributes powered assistance to movement beyond that range, to the boundaries of a rehabilitative range. Over time, by such supported movement into a rehabilitative range, the volitional range of motion may expand toward the expanded boundaries described by the rehabilitative range.

Embodiments of the rehabilitative method described herein may be described in various aspects. In one aspect, the method is basically directed toward increasing the functional capability of a joint. The method includes the fastening of a device around a joint so as to be able to move the joint with the device, the patient moving the joint volitionally within his or her volitional range of motion, the powered device then supporting movement of the joint beyond the volitional range. From the perspective of the joint, in one phase, the joint is substantially under the volitional control of the patient, and then, in a second phase, the powered device engages and contributes support to the movement of the joint. These phases may alternate, and further, the method may include excursions alternately in directions of extension and flexion to form a cycle. Still further, cycles may be repeated.

Returning to the basics of the method, as described above, in a more specific aspect, the patient's volitional effort is substantially responsible for moving the joint from a starting point (approximately central point in his or her range of volitional motion) to the patient's unassisted volitional boundary. At that boundary point, the powered device then becomes substantially responsible for providing force to move the joint. The powered device may then move the joint into an expanded range of motion, and toward an expanded boundary. Saying that the patient's effort is substantially (may not be wholly) responsible for movement within the volitional range is because in some embodiments, the device may contribute some force in order to counteract the force of gravity, this, in some instances, being therapeutically desirable. Saying that the powered device is substantially (not wholly) responsible for the movement is because it is not plausible (nor desirable) to preclude patient contribution to movement beyond that which was determined to be an unassisted boundary of volitional movement.

In another specific aspect of the basic method as described above, again, the effort of the patient is substantially responsible for moving the joint from a starting point, but that starting point may occur anywhere within the unassisted range of volitional motion, and it may also occur even beyond that, in an expanded rehabilitative range.

Various embodiments of the rehabilitative method of the invention are shown in the flow diagram of FIGS. 1-5. FIG. 1 depicts an embodiment 100 of the method in its most basic form. In Step 1, a powered device, or more specifically, an orthotic portion of a powered device, is fastened or applied to sites on either side of a patient's joint. In some embodiments, the method may be applied to more than one joint, in which case, fastening refers to applying an orthotic portion of a powered device at each of the respective joints. Described in the system description section below, for example, are orthotic devices that may be applied to the ankle alone, knee alone, or the combination of the ankle and knee. At the outset of a Step 2, the patient's joint is in a starting position, and the powered device is in a free movement mode that provides substantially no assistance or resistance to movement of the joint. During the Step 2, the patient volitionally moves the joint to the boundary of his or her volitional range of movement. At the outset of a Step 3, therefore, the joint is at the boundary of the volitional range, and the powered device has been switched from a free-movement mode to an assist mode. During Step 3, the powered device moves the joint to the boundary of an expanded rehabilitative range of motion and then assists the joint back to the boundary of the volitional range. In a Step 4, the joint returns to the starting position.

Embodiments of the method include variations in the ways in which the device assists in movement. For example, while movement during Step 2 is substantially under the volitional control of the patient, in some embodiments of the method the device may provide some assistance for the purpose of counteracting, or partially counteracting, gravitational force that can limit joint movement. Convenient positions for exercising the method, without this variation, could skew forces needed to move a joint such that either extension or flexion could be favored.

In another embodiment, the assisting of movement by the device that occurs in Step 3 may be one in which the device provides all the force needed to move the joint, or, in another embodiment, the device may be set in a ratchet mode, where the assistance it provides is in the form of not allowing retrograde movement away from the desired volitional boundary, and permitting movement only toward the desired volitional boundary. Retrograde movement, in this context, refers to movement in the flexion direction when extension is desired, or in the extension direction when flexion is desired. This latter mode provides the patient an opportunity to exert force against a backstop, thereby training neural pathways and muscles in a context that would not be available under unassisted conditions.

Figure 2:
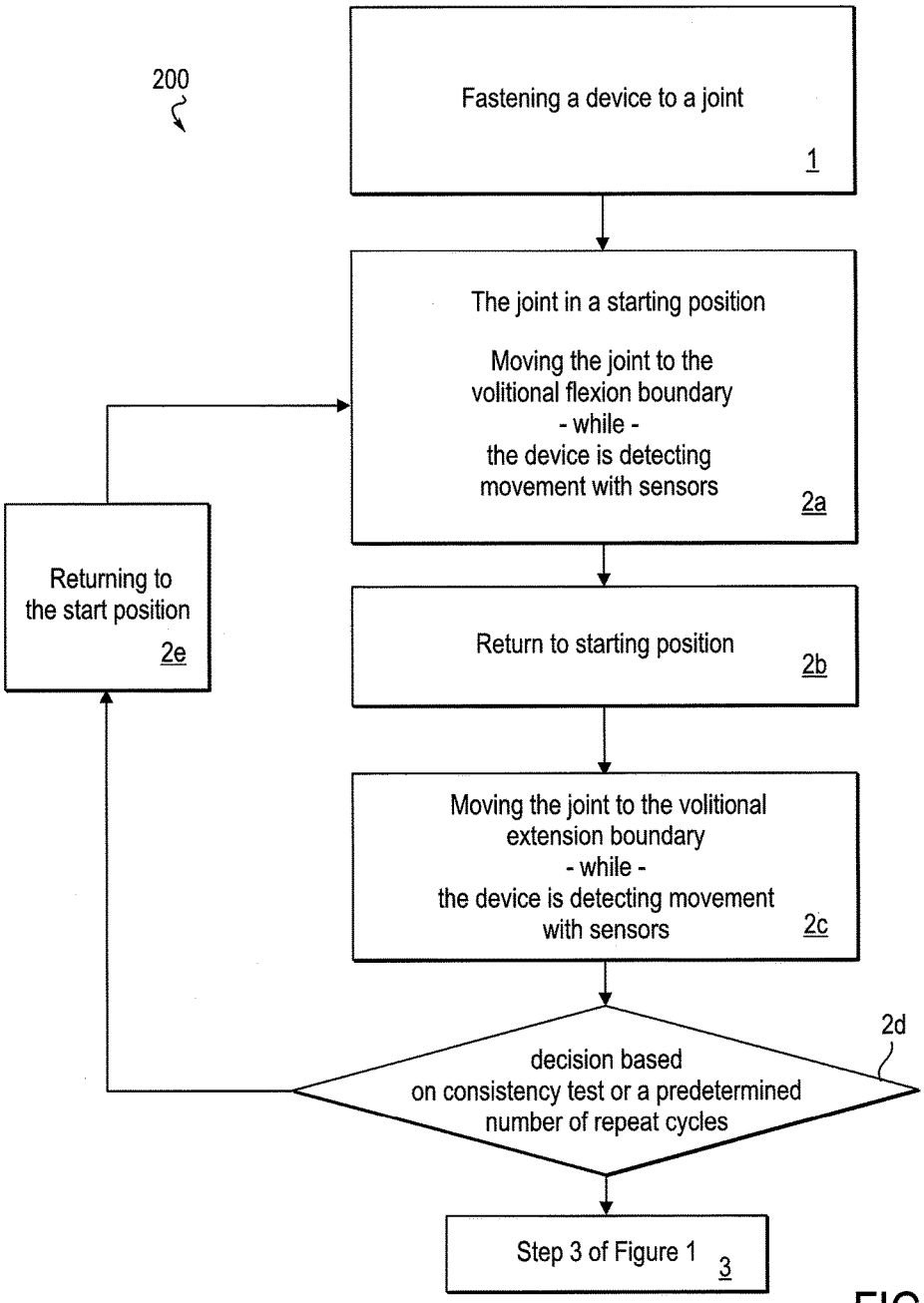

FIG. 2 shows details of an embodiment of the method 200 that occur during Step 2 described above, in which movement of the joint occurs substantially under the control of the patient, and while the device (which includes an actuator, a sensor, and an orthotic, controlled by the actuator) is in a free movement mode. Step 2 may also be referred to as an assessment phase of the method, as during this phase, the device is detecting the range of motion through which the patient is capable of moving the joint volitionally. Thus, Step 2*a* begins with the joint at a starting position, typically a position within the patient's volitional range of motion or between current volitional boundaries of extension and flexion.

During Step 2*a*, as described above, the patient moves his or her limb to the boundary of volitional movement. During this assessment phase of the method, sensors that are operatively coupled to the device and to a controller monitor joint movement and track the position of the joint. Such sensors may include, by way of example, any one or more of joint angle sensor (such as, e.g., a variable resistor or an optical encoder), a force sensor, a movement sensor, and/or a current sensor. By monitoring the range of positions through which the joint moves during this assessment phase, the current volitional range of motion is determined. In addition to such sensed information, the controller also has a clock so that sensor data can be differentiated with respect to time, thereby adding a time or rate dimension to otherwise static information. Finally, in some embodiments the device uses sensor information to track and control the assistance provided to the patient's joint movement.

In Step 2*b*, the joint returns from the boundary of volitional movement back to the starting position without assistance of the device Steps 2*a* and 2*b* may occur in the direction of either flexion or extension. Step 2*c* is analogous to Step 2*a*, except that it occurs in the opposite direction, either flexion or extension, as that which occurred in Step 2*a*. Step 2*e* is analogous to Step 2*b*, and the joint returns to the starting position. Following Step 2*c* is a decision step 2*d* in which a determination is made as to whether the method next goes to Step 3 (as detailed in FIG. 1), or whether the method is directed on to Step 2*e*, wherein the joint returns to the starting position. By so returning to the starting position, and thus an iteration of Step 2*a*, embodiments of the method may include a repeating loop of Steps 2*a*-2*e*. The decision as to which method path to pursue (Step 3 or Step 2*e*) may be based on any appropriate criteria. For example, this decision may be made based on a predetermined number of repeat cycles, or the controller may exercise a statistical test of consistency in the boundary reached by the patient, or a predetermined number of repeat cycles may override a statistical test of consistency, should the consistency criterion not be met. In this context, the predetermined number of repeat cycles may be set by, for example, a health care professional or a patient who is informed and trained in the method. Statistical tests of consistency may include any of those well known in the art and appropriate for the data. An object of Steps 2*a*-2*d* is to allow the device and controller to determine the boundaries of volitional movement of which the patient is capable, thus a benefit associated with repeating Steps 2*a*-2*d* is an increase in the accuracy of determining that boundary.

Figure 3:
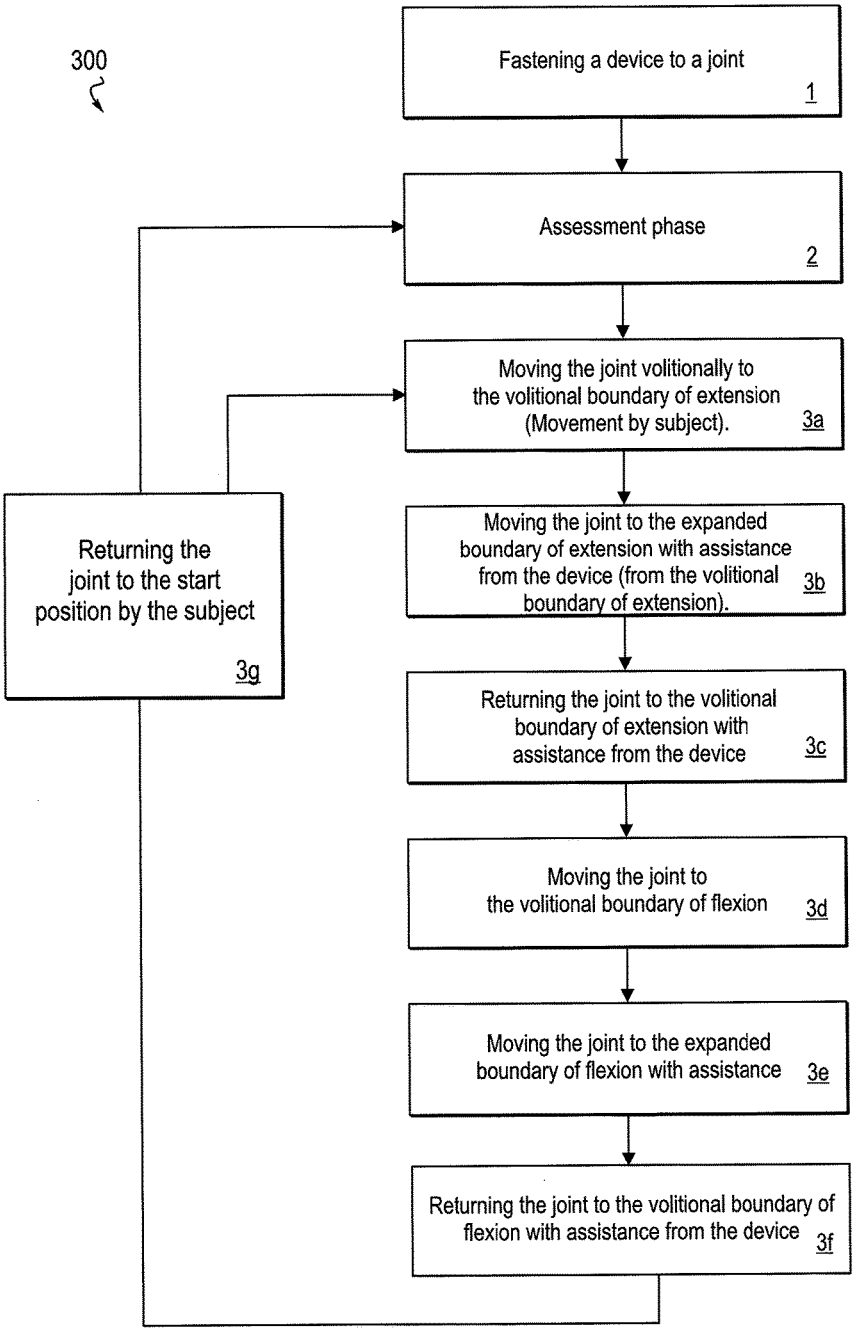

FIG. 3 depicts Step 3 of an embodiment 300 of the method as depicted in FIG. 1 in more detail. After completion of Steps 1 and 2, in Step 3*a*, the patient moves the joint to the volitional boundary. In Step 3*b*, the powered device assists in the movement of the joint from the boundary of volitional movement to the boundary of the extended range of motion or rehabilitative movement. This extended range of motion boundary is a controlled and predetermined boundary that may be set by various formulas or algorithms, or, for example, by the judgment of a medical professional, overseeing the therapy, or by a patient that is sufficiently informed and trained in the method. Step 3*c* is initiated after the limb has attained the extended range boundary, and the joint is returned with assistance back to the volitional boundary and then volitionally back to the starting point. Some embodiments may provide the return back to the starting position from the volitional boundary as an assisted movement and other embodiments may provide this as an unassisted movement and under the patient's volitional control. As with the assessment phase (per Step 2) and movement within the range of volitional movement described above, Steps 3*a*, 3*b*, and 3*c* may occur in the direction of either extension or flexion. The method continues with Steps 3*d*, 3*e*, and 3*f* wherein movements analogous to those of Steps 3*a*, 3*b*, and 3*c* occur in the opposite respective direction of either flexion or extension.

Following the conclusion of Step 3*f*, according to various embodiments of the method, the method proceeds to Step 3*g*, marking a return of the joint to the starting position, the method may then proceed with a repetition of Steps 3*a*-3*f*, or the method may return to Step 2. The duration of a therapeutic session that includes Steps 3*a*-3*g* may be at the discretion of a medical professional overseeing the therapy, or it may be at the discretion of a sufficiently informed and trained patient. In some embodiments of the invention, the number of repetition cycles may be predetermined or programmed. Similarly, the rate of the cycles (i.e., cycles per unit time) may be predetermined or programmed.

Figure 4:
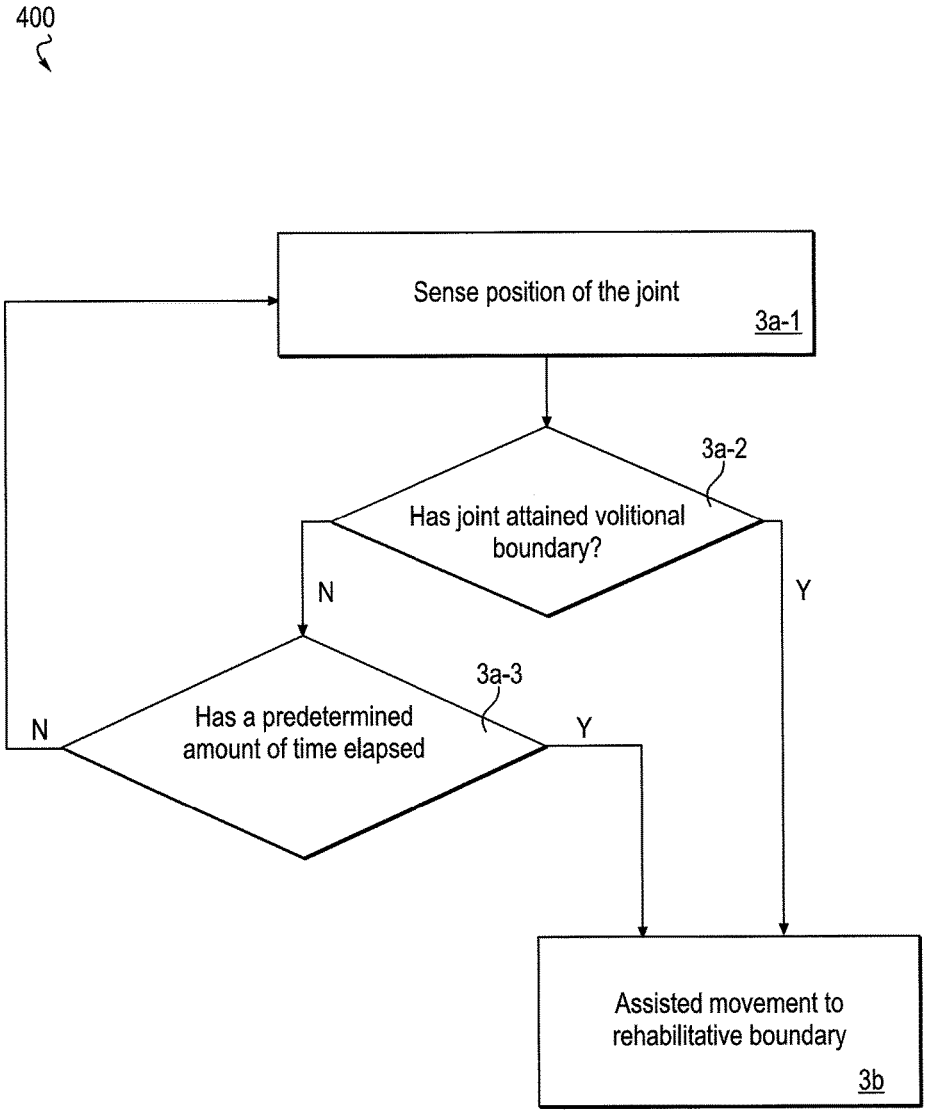

Another embodiment 400 of the method is shown in FIG. 4, in which the assist phase of the method includes a waiting step, i.e., waiting for a predetermined period of time, prior to the method proceeding to the assisted movement to a rehabilitative boundary. In the initial step of this embodiment of the method, Step 3*a*-1, the position or status of the joint is sensed by one or more sensors. In the Step 3*a*-2, the controller determines whether the joint has attained the predetermined boundary (predetermined either by the assessment phase, or by a value put into the system by a healthcare worker, or an informed and capable patient, or other acceptable method). In Step 3*a*-3, that follows a "no" answer to the Step 3*a*-2 query (has the volitional boundary been reached), the system queries whether the predetermined amount of time has elapsed. If the Step 3*a*-2 answer is "no", the method loops back in a return to Step 3*a*-1. In the event of a "yes" answer to the query of Step 3*a*-2, (i.e., "yes, the predetermined amount of time has elapsed"), the method proceeds to Step 3*b*, wherein the device supports the movement of the joint toward the rehabilitative boundary. In summary, therefore with regard to a "yes" answer to the query of Step 3*a*-3, the joint has failed to move to the volitional boundary within the allotted (predetermined) time, so the method proceeds with the device assisting movement from whatever the current position of the joint may be thru the (unattained) volitional boundary and on to the extended or rehabilitative range of motion boundary.

Returning to Step 3*a*-2, and obtaining a "yes" answer to the query (rather than a "no", as detailed above), the method proceeds to Step 3*b*, wherein the device then engages and assists movement of the joint beyond the attained volitional boundary, and toward the rehabilitative boundary. The overall effect of this embodiment of the method is that the setting of a boundary of volitional movement provides a reasoned or reasonable joint movement goal for the patient, and it provides a reasonable time for the achievement of that goal. In practice, for example, this amount of time could provide sufficient time for a second exertion of the patient to occur if an initial effort to move the joint has failed. On the other hand, if the goal cannot be achieved in the allotted time, the desirable therapeutic path may be for the method to proceed with moving the joint with the assistance of the device, even if the joint is short of the volitional boundary, as provided by this embodiment. In this manner, the patient may receive a full sensory motor experience through the volitional and extended range of motion, which is the sum of the patient's own movement capability plus the movement assisted by the device, and thereby may potentially exercise or achieve retraining of neural pathways.

Figure 5:
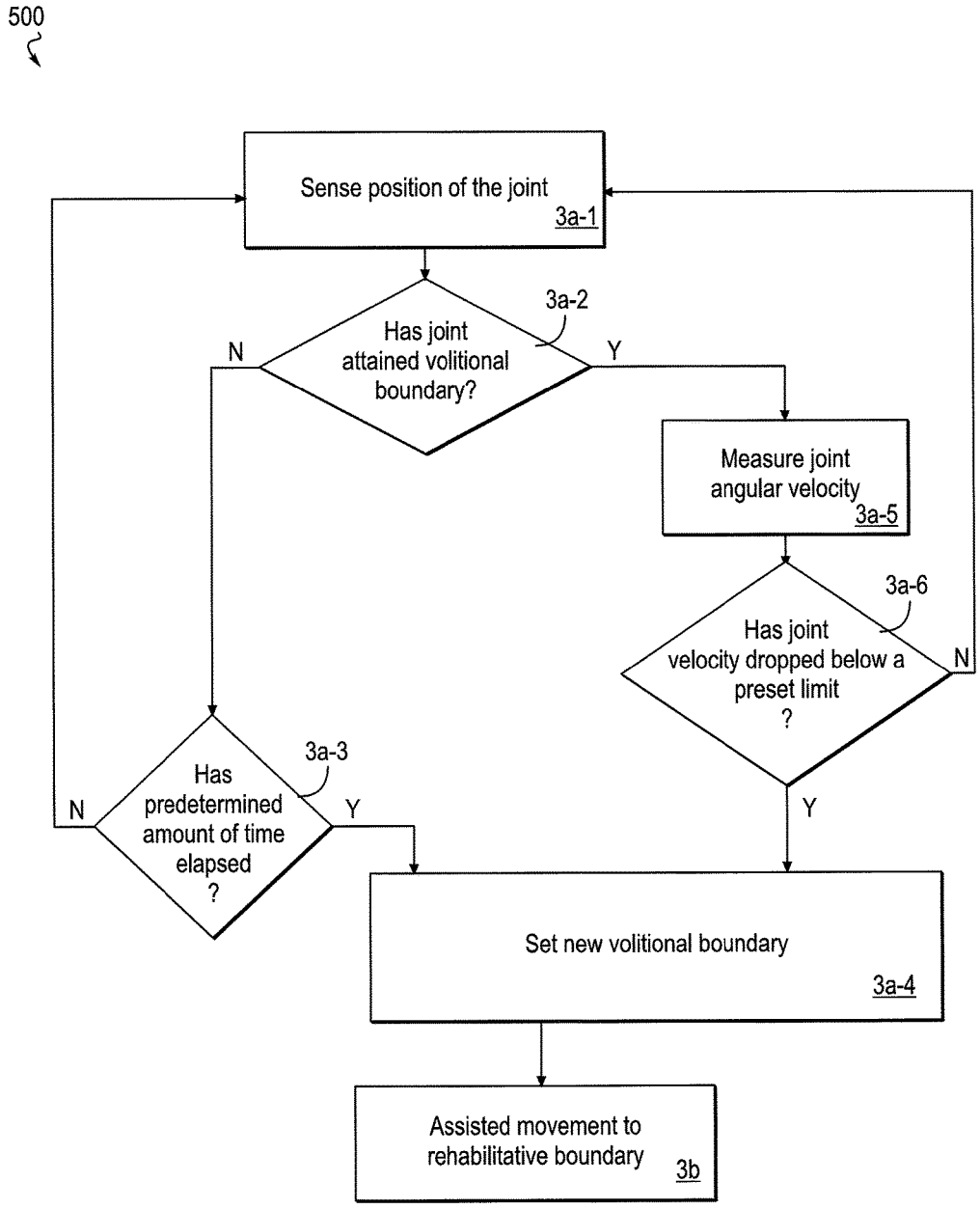

FIG. 5 shows another embodiment 500 of the method that expands upon the "waiting" feature of the method embodiment shown in FIG. 4, as described above. In this embodiment of the method, the volitional range of motion is continuously re-evaluated during iterations or cycles of the assist phase (Step 3 of FIG. 1) of joint movement, and the volitional range or boundary may be modified during this assist phase, rather than requiring a return to the assessment of volitional range per Step 2 of the method. This embodiment of Step 3 includes an ongoing testing, heuristic, or trial-and-error-based tuning aspect of the method that is based on the performance of the subject with regard to volitional joint movement. This testing may occur within the method in addition to the initial assessment phase that underlies the establishment of a baseline volitional boundary, i.e., the assessment phase (Step 2) as seen in FIG. 1.

As provided by this embodiment (FIG. 5), the assist phase (Step 3) begins (3*a*-1) with sensing, at time intervals, the angle or position of the joint and a query (3*a*-2) as to whether the joint has attained the current volitional boundary (as established, for example, during Step 2). This embodiment then conducts a series of steps in various loops that contribute to the heuristic aspect of the method before proceeding to Step 3*b*, when the device assists or supports movement toward a rehabilitative boundary. The affirmative answer or negative answer to the query as to whether the existing volitional boundary has been attained directs the course of the method into divergent loops, but which later converge ultimately into an opportunity to alter or reset the volitional boundary (3*a*-4) and then for the powered device to engage the joint (3*b*) and assist or support movement toward a rehabilitative boundary.

The path that the method takes upon receiving a negative response to a query (3*a*-2) as to whether the joint has attained the volitional boundary is then to a query (3*a*-3) as to whether a predetermined amount of time had elapsed at the time of the attainment query (3*a*-2). A negative response to the 3*a*-3 query returns the method to 3*a*-1, wherein the position of the joint is sensed again. From the perspective of the method, a loop-iteration has occurred; from the perspective of the subject, he or she is simply continuing to move or attempt to move the joint. Basically, as above, this particular series of steps (3*a*-1, 3*a*-2, 3*a*-3, and 3*a*-1) provides a given period of time for the subject to succeed in attaining the volitional boundary before the method has the powered device engage and assist in joint movement to an expanded or rehabilitative boundary.

Returning now to the Step 3*a*-2, receiving a "no" to the query as to whether the volitional boundary has been attained, thence to the query of Step 3*a*-3, and in this instance receiving a "yes" to that query as to whether a predetermined amount of time has elapsed, the method ultimately proceeds to have the powered device engage and (Step 3*b*) assist or support movement of the joint. However, before going to Step 3*b*, Step 3*a*-4 intervenes, wherein the volitional boundary may be adjusted. In general, the response of the volitional boundary setting (3*a*-4) which follows a sequence from Step 3*a*-3, wherein the subject has been unable to move the joint to the boundary within an allotted time, is to decrease the volitional range that is invoked during the next iteration of the method following Step 3*b*, and further following the steps shown in FIG. 3. The adjustment of the boundary, in this case, decreasing the boundary, occurs by way of an application of an algorithm. The volitional boundary may be adjusted based on a function of the history of the patient's recent success or lack of success in reaching the volitional boundary. One algorithm is a simple average of the limit reached by the patient compared to the current volitional limit. If the average exceeds the current volitional limit, the limit is expanded by some delta amount. Other algorithms may use weighted averages, giving more weight to recent trials than to older trials. Other algorithms may prevent unusually good or bad trials from affecting the average by discarding data based on trials where the patient's performance was much better or worse than recent averages.

This sequence of steps (3*a*-1, 3*a*-2, 3*a*-3, 3*a*-4, and 3*b*) results in a sequence in which the patient fails to reach the volitional boundary within a predetermined amount of time the next joint movement cycle to follow is one in which the volitional boundary has been decreased, and thus easier for the subject to attain. These features provide the benefits of encouraging, or at least not discouraging the subject by having to face an unattainable or ever more difficult goal. From the perspective of the subject, if the goal was unattainable, even if only in that particular attempt, the next volitional joint movement attempt will have a less ambitious goal. Further, an effect of changing the volitional boundary (in this case, decreasing the boundary) during this step is to keep the volitional boundary appropriately tuned to the status of the patient, moment by moment.

Returning now to the query posed during Step 3*a*-2 of FIG. 5 (has the joint reached the volitional boundary?), in the event of "yes" in Step 3*a*-5, the angular velocity of the joint may then be determined by one or more sensors, and in cooperation with a clock or timing feature that participates in the method. Following that velocity measurement (3*a*-5), in Step 3*a*-6, it may be queried as to whether that angular velocity, at the moment when the volitional boundary was attained, was less than a preset threshold limit. In the event of a "no" to that query (i.e., the joint is still moving at a velocity higher than the threshold), the method may return to Step 3*a*-1, for another sensing of the position of the joint. From the perspective of the subject, the subject simply continues to move the joint. The effect on the rehabilitative method of this particular loop (3*a*-2, 3*a*-5, 3*a*-6, and 3*a*-1) is that the joint is allowed to continue to move until it slows below a threshold velocity. This aspect of the method allows the subject to exert whatever force he or she can to a full extent before the method engages the powered device to assist or support movement toward a rehabilitative boundary. Stated in another way, this loop prevents what could be considered a therapeutically premature engagement of the assistance of the powered device.

Ultimately, a joint being moved volitionally by a subject who has moved the joint beyond the set volitional boundary will slow down as the subject comes to his or her own actual volitional boundary of the moment, and the velocity of the joint will drop below a preset limit or established threshold velocity. At this point, the method will ultimately have the powered device engage the joint, and move it toward an expanded or rehabilitative boundary as in Step 3*b*. However, before that, Step 3*a*-4 intervenes, wherein the volitional boundary may be adjusted. In general, the method increases the volitional boundary in response to the subject being able to move the joint beyond the volitional boundary that was previously established. The adjustment of the boundary may occur through the application of an algorithm. An example of an algorithm appropriate for adjusting the volitional boundary makes use of a weighted average approach, whereby the previous volitional boundary is increased by an amount that corresponds to the difference or delta between the previously set boundary and the attained boundary, the delta being reduced by a constant introduced into the algorithm.

From the perspective of the subject, the experience is one in which the method engages the subject intelligently. In this case, the subject has exceeded expectations as to what the volitional boundary was, and therefore, upon the next iteration of the method, the subject faces a volitional boundary that is incrementally larger.

FIG. 5 thus shows two loops in the method, one in which the previously established volitional movement boundary can be decreased (Steps 3*a*-1, 3*a*-2, 3*a*-3, and 3*a*-4), and one in which the previously established volitional movement boundary can be increased (Steps 3*a*-1, 3*a*-2, 3*a*-5, 3*a*-6, and 3*a*-4). FIG. 1E shows both of these loops, each of which may operate independently of the other. Thus some embodiments include both loops, and others may contain just one. These steps, which can be considered a form of testing the subject, do not replace the initial or first-approximation assessment aspect of Step 2. The steps of this embodiment (FIG. 5) enhance the method in several ways. For example, subject progress is immediately taken into account during the assisted phase, without having to return the method to Step 2 for a "reassessment". Further, there is less reliance of the accuracy of Step 2 in finding a "true" volitional boundary, as by these described steps the boundary can be tuned to become increasingly or currently accurate during the assist phase of the method. And still further, these steps allow the method to therapeutically engage the subject more intelligently, as the subject is appropriately either relieved or challenged during the method. Subjects that are appropriate for the inventive method described herein face enormous difficulties in any rehabilitative path they pursue. These presently described steps may also contribute benefit to the spirit and compliance of the subject by alleviating such things as frustration (if it's too hard, the method goes forward anyway, and it becomes easier), a sense that the therapy may not doing any good (if it's too easy, the challenge is ramped up), or that it's boring or mechanical (the method engages the subject by appropriately responding to the subject).

Figure 6:
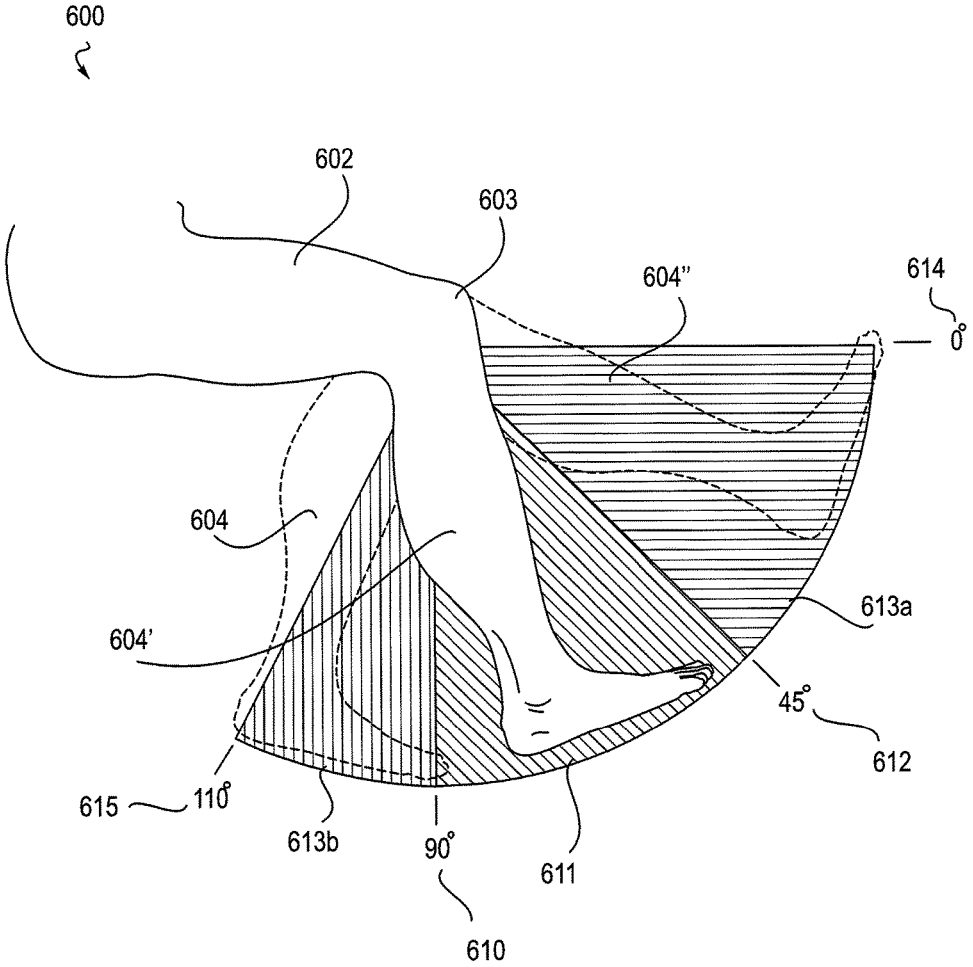
FIG. 6 shows views of a knee joint as situated in a robotic knee device (the device not shown), with the angle of the knee in varying positions within ranges of motion.

FIG. 6 shows a schematic view of a leg 600 of a subject, more specifically, a knee joint 603 and lower leg 604 in three positions that depict aspects of embodiments of the method; the knee and lower leg may be understood to be secured within an orthotic device secured to the thigh 602 and the lower leg 604, the device being actuated by an actuator (the orthotic and actuator not shown). The knee joint 603 can be seen to have a potential range of motion that extends from 0° at full extension to about 110° at full flexion. The arc 611, extending between boundary 610 at 90° and boundary 612 at 45° is an exemplary volitional range of motion for the knee 603. Lower leg 604 is seen situated approximately in the center of arc 611, at an exemplary starting point for the method. The lower leg is also shown in an extended position 604", within the bounds of arc 613*a*, a rehabilitative range of motion in the direction of extension, extending between boundary 612 at 45° degrees and extension boundary 614 at 0°. The lower leg is also shown in an extended position 604', within the bounds of arc 613*b*, a rehabilitative range of motion in the direction of flexion, extending between boundary 610 at 90° and flexion boundary 615 at 110°. As provided by the method, movement of the joint within arc 611, is substantially under the volitional control of the patient, and movement beyond arc 611, either by extending into arc 613*a* or flexing into arc 613*b* is substantially due to the active engagement of the device, providing a sufficient and appropriate amount of force.

Figure 7A:
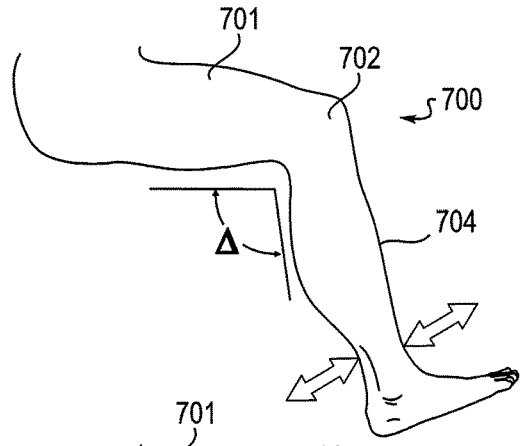
FIGS. 7A-7D depict aspects of a method wherein a powered device supports movement of a joint in a ratchet-like manner such that movement is allowed only in one direction.
Figure 7B:
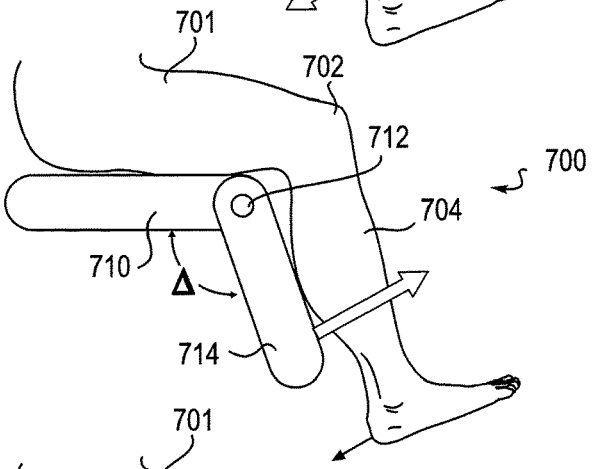
Figure 7C:
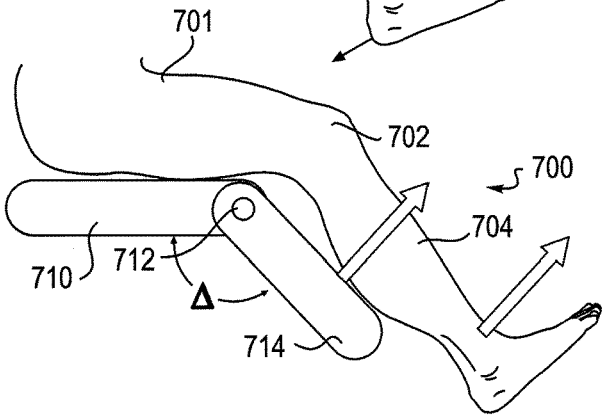
Figure 7D:
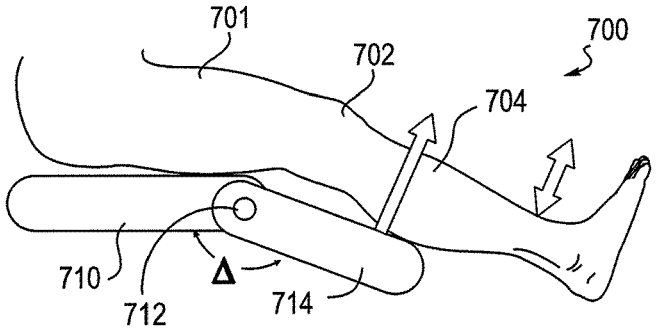

FIGS. 7A-7D depict a leg 700 demonstrating aspects of an embodiment of the method wherein the inventive system and method support movement of the joint by permitting movement only in one direction, in a ratchet-like manner. These figures show a thigh 701, a knee 702, and a foreleg 704. FIGS. 7B-7D show a schematic representation of a portion of powered device which may be fastened about the knee, including a support portion 710 for the thigh and a support portion 714 for the foreleg. FIGS. 7A-7D illustrate only the forces applied during leg extension to prevent movement in the flexion direction. Straps or other attachments to the leg, not shown in FIGS. 7A-7D, apply forces to prevent leg flexion when the goal is to extend the leg. By way of an overview of this embodiment of the method, a patient initiates an extending movement of a knee joint 702 from a starting position that is well within his or her range of volitional motion, and at some point comes to rest the joint at what is, at least in that particular instance, a boundary of volitional motion. Until that volitional stop, the device has permitted extending movement, but not otherwise intervened. However, upon volitional joint movement stopping, the device, in a ratchet-like manner, disallows retrograde or back movement toward the starting point. With the joint supported in a backstop-like manner, the patient is able to regroup, and volitionally move the joint still further forward in an extending direction. In this manner, the patient is able to move the joint beyond what would be a boundary of unassisted movement, and to volitionally explore a realm of otherwise inaccessible rehabilitative movement.

Embodiments of the method generally outlined above, will now be considered in more detail, with reference to FIGS. 7A-7D. FIG. 7A shows a knee joint 702 in a neutral position, without being accommodated into a powered device, wherein uncontrollable, spastic, or misdirected movement may occur coincidentally with movement in a desired direction. FIG. 7B depicts the backstop-like feature of the device, schematically depicted with a thigh support portion 710 and a lower leg support portion 714, the two portions forming an angle Δ at the device joint or fulcrum 712. When the powered device is operating an embodiment of the method in a ratchet mode, it physically prevents movement in the incorrect direction. In this case a movement of the knee joint 702 in an extending direction is desired, and movement in a flexing direction is incorrect or undesired, and is blocked by an unyielding device portion 714 supporting the lower leg 704. FIG. 7C shows the joint being supported by the backstop support of the device, the knee joint 702 in the most forward or extending direction that the patient was volitionally able to achieve. From this position, as seen in FIG. 7D, the patient is able to mount another effort to move the knee joint 702 further in the direction of extension.

Electronics and Control System Block Diagram and Operation (from DVT)

In another aspect of the invention, a system for controlling movement of a joint of a patient is provided. The system includes an actuator coupled to an orthotic or brace that is attached or fastened to both sides of a joint; the actuator is configured to activate the orthotic to move, or to assist in the movement of the joint in directions both of flexion and extension. The system further includes at least one sensor adapted to determine an angle of the joint, and the system further includes a controller, such as a computer, that is operably connected to the actuator and one or more sensors that send data to the controller regarding the position or angle of the joint and possibly the force applied to the joint by the orthotic. In response to those data, the controller controls the operation of the actuator. The actuator moves the orthotic, and the orthotic, in turn, moves or assists in the movement of the joint. Typically, the actuator is in a free movement mode when the patient's joint is at an angle within the range of voluntary control of the patient. Further, typically, the controller switches the actuator to a joint movement assist mode when the angle of the joint reaches the boundary of the patient's volitional range, and the actuator then assists in movement that extends beyond that range. Details of the system and its components are included in this and the following sections.

Some aspects of the system and the knee orthotic have been disclosed in U.S. Pat. No. 6,966,882, which was filed as U.S. application Ser. No. 10/704,483 on Nov. 6, 2003, and which is hereby incorporated by this reference in its entirety. Aspects of an ankle orthotic have been disclosed in U.S. Pat. No. 8,353,854, which is also hereby incorporated by this reference in its entirety.

Figure 8:
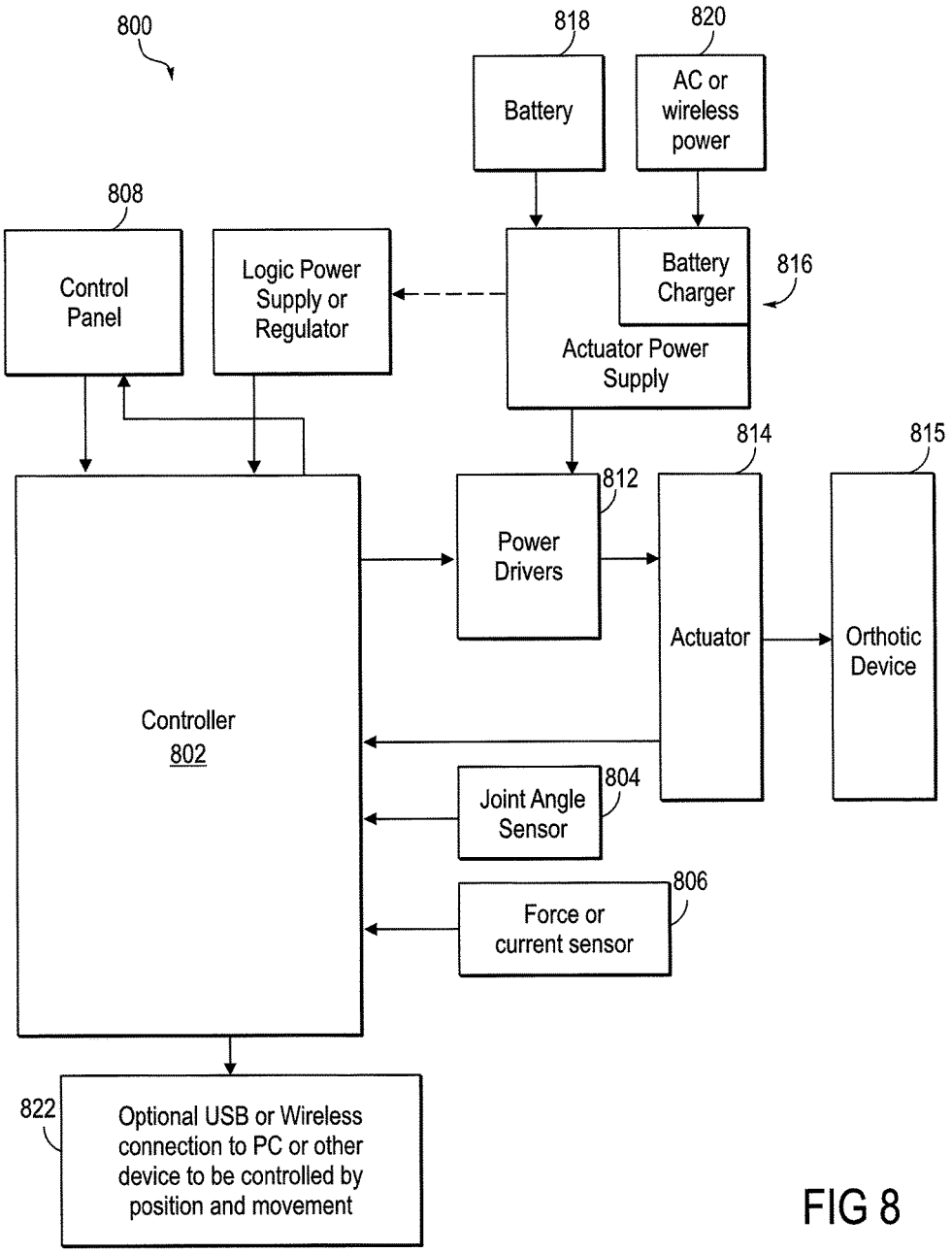
FIG. 8 is a block diagram of a system that implements the rehabilitative method.

FIG. 8 is a block diagram of a rehabilitation system 800 according to an embodiment of the present invention. Controller 802 is programmed to accept input from one or more sensors such as joint angle sensor 804 (such as, for example, a variable resistor or an optical encoder) or a force sensor 806.

The force sensor determines the amount of force the actuator is applying to the joint. Such a sensor is desirable to allow the heath care professional to limit the chance of injury by setting a patient-specific force limit to be enforced by the controller. The force sensor can be implemented by detecting the mechanical strain via a strain gage or load cell located on a structural element where the actuator attaches to the brace. Alternatively, the force can be determined by resistive, piezoelectric or capacitive force elements between the actuator and brace or between the brace and the place where the brace applies force to the limb.

The applied force may also be estimated by detecting the amount of current applied to one or more motors in the actuator. The force applied to the joint is based on the motor torque which may be derived from the motor current based on the torque constant of the motor. The joint force is also based on the drive ratio that relates the angular velocity of the motor to the angular velocity of the joint. Hence the controller can compute the applied force based on the instantaneous motor current plus other known constants.

Controller 802 may also be coupled to a control panel 808 that may be used by a patient, a doctor, or other health care provider. The control panel 808 may be as simple as an on/off switch, or may include switches and displays to allow adjustments for the range of motion, minimum repetition frequency, movement statistics, battery charge, and the like. Controller 802 is operable to produce outputs for power drivers 812 to control the motion of one or more actuators 814, which, in turn, engage one or more orthotic devices 815, such as a knee brace or ankle brace, as described further below. With further reference to FIG. 8, power is supplied to the rehabilitation system 800 through an actuator power supply 816. Power may come through a battery 818 or from an AC adapter 820. In one embodiment, the battery 818 is wirelessly recharged by inductive coupling to a pad conveniently placed, such as at the foot of a hospital bed. Providing sensed input into the controller 802 may be one or more joint angle sensors 804, and one or more force or current sensors 806.

In certain embodiments, such as cases where the patient can supply significant force to exercise a joint, the battery charging requirements may be reduced or eliminated by recharging the battery from energy captured from running the actuator 814 as a backdriven generator. One embodiment of the system includes a USB or wireless connection 822 to allow the rehabilitation system 800, with a single device or pairs of rehabilitative devices (e.g., paired for the left and right side of the body), to act as a human interface device (HID) that may be connected, for example, to a controller such as a computer. Another embodiment is that the USB or wireless connection 822 may be used to provide data indicative of patient status or performance to a computer or reporting device.

An Ankle Device (from DVT Application)

Figure 9:
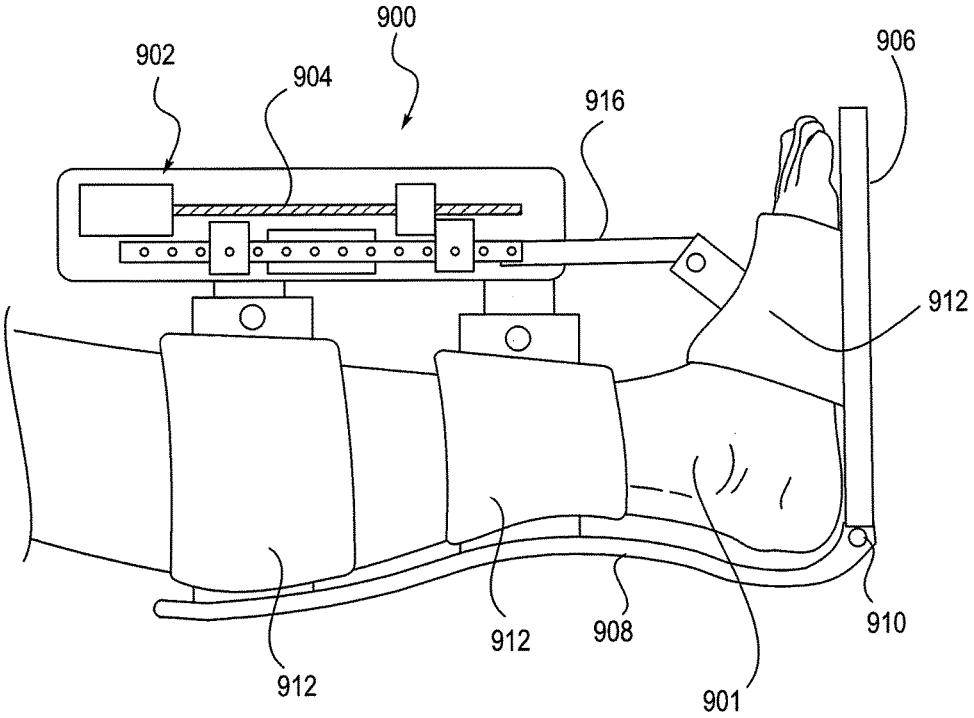
FIG. 9 shows a robotic ankle device that can be used in the implementation of the method.

FIG. 9 shows an embodiment of an ankle orthotic 900 operably connected to an embodiment of a single motor actuator 902. More specifically, the actuator 902 is attached to an ankle support 912 and coupled to a foot support 906 through a linkage 916 of the orthotic 900. In this embodiment, a ball screw 904 is used in the actuator 900 and shown in a position about to extend the ankle by pushing to the right. In other embodiments, the ball screw 904 may be replaced with a cable system or other components to transfer force. Near the extension and flexion limits, some compliance may be built in to provide more comfort to the patient and to assure that there is no possibility of injuring the patent. This may be accomplished by springs in the actuator 902 or springs in the linkage 916, or both (not shown), that expand or compress before damaging forces are applied. The actuator is described in some greater detail below, and depicted in greater detail in FIG. 11.

To further elaborate, a free-movement mode of the actuator 902 allows the patient to move the ankle with little or negligible resistance. The free movement mode obviates the need to remove the ankle orthotic device after it has been secured, such as for when the patient is generally in a therapeutic context, and allows the patient to continue to wear the device when the patient needs to be able to walk freely. This free-movement mode improves patient compliance because there is no need for the patient or hospital staff to remove and reattach the ankle orthotic device in order to allow the patient to ambulate.

With further reference to FIG. 9, a rigid foot support structure 906 is placed under the foot and a rigid ankle support structure 908 is placed behind the calf. The two support structures 906 and 908 are connected to each other with a hinge 910. The actuator 902 is mounted to the upper rigid structure 908. Straps or padded supports 912 hold the ankle support structure 908 and actuator 902 to the lower leg. An output shaft of the actuator 902 is connected to a linkage 916 attached to the foot support structure 906. One or more straps 912 hold the foot support structure 906 to the foot.

Figure 10A:
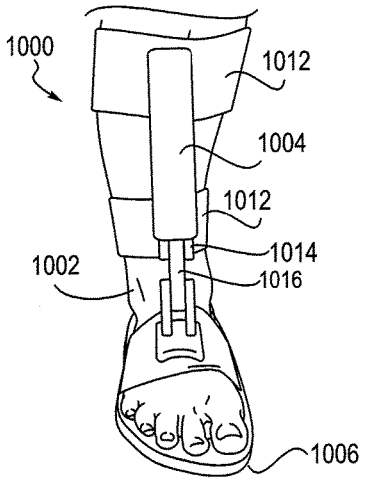
FIGS. 10A-10C show views of a foot placed in an ankle device.
Figure 10C:
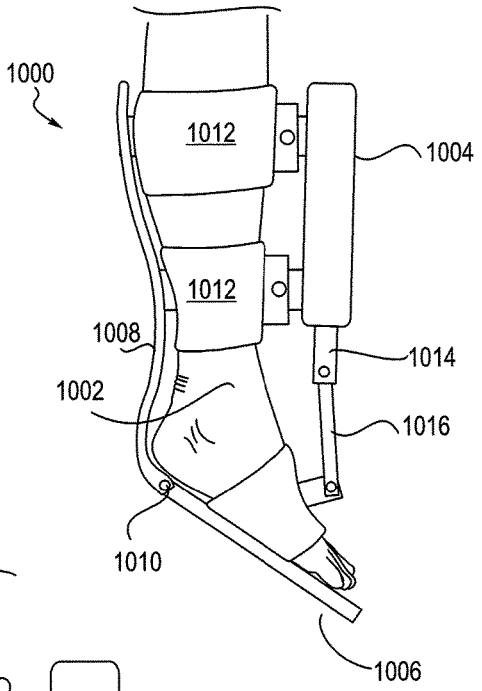
Figure 10B:
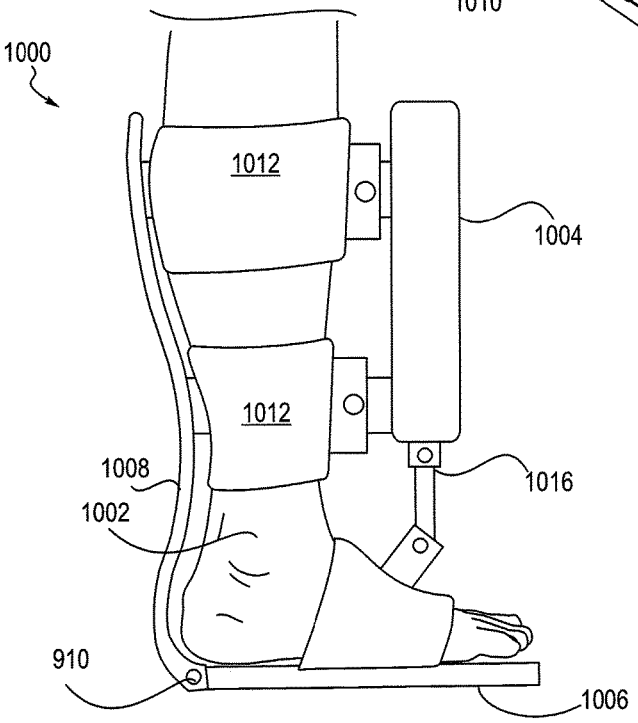

FIG. 10 shows three further views of an embodiment of an ankle orthotic device 1000, according to another embodiment of the present invention, attached to an ankle 1002. An actuator 1004 is attached to upper and lower ankle attachment points such that activation of the actuator 1004 may extend or flex the ankle 1002. FIG. 10A shows a front view of the ankle orthotic device 1000, FIG. 10B shows a side view of the ankle orthotic device 1000 near a standing position, and FIG. 10C shows a side view of the ankle orthotic device 1000 near an extension limit. The limits may be programmatically or physically limited within the patient's range of motion. As will be appreciated, a typical extension limit (planar flexion) is about 45 degrees from the standing position of the ankle, and a typical flexion limit (dorsal flexion) is about −20 degrees from the standing position.

Figure 11:
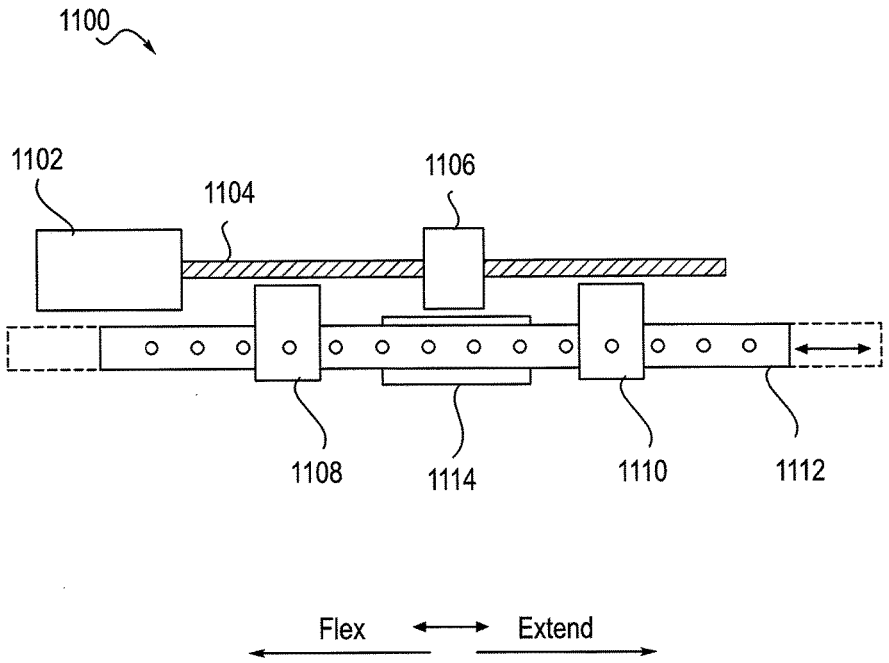
FIG. 11 provides a detailed view of a single-motor actuator that is shown in FIG. 9.

FIG. 11 shows a single-motor actuator 1100 suitable for use as an actuator according to an embodiment in the present invention. In the single-motor actuator 1100, a motor 1102 drives a lead screw 1104 to move a ball nut 1106 linearly. The lead screw 1104 may be an acme screw, a ball screw with a ball nut for lower friction and higher motor efficiency, or any other suitable screw. The ball nut 1106 is always between a flexion stop 1108 and an extension stop 1110 connected to an output shaft 1112. When the ball nut 1106 is in a center of travel, the output shaft 1112 is free to move linearly in either direction without having movement impeded by interaction with the ball nut 1106. This position provides free movement of the output shaft 1112, and likewise free movement of the ankle or other relevant body part, even with no power applied to the actuator 1100. When it is time to extend or flex the ankle, the ball screw 1104 is turned to move the ball nut 1106 to the left or the right where the ball nut 1106 eventually pushes against the flexion or extension stop. Further movement of the ball nut 1106 in the same direction moves the flexion stop 1108 or the extension stop 1110, and hence moves the output shaft 1112, thus causing the ankle to flex or extend, respectively. The output shaft 1112 is supported by one or more linear bearings 1114 allowing the output shaft 1112 to move freely in one dimension while preventing substantial movement or twisting in other dimensions.

A Knee Device

General Overview of a Knee Brace

Figure 12:
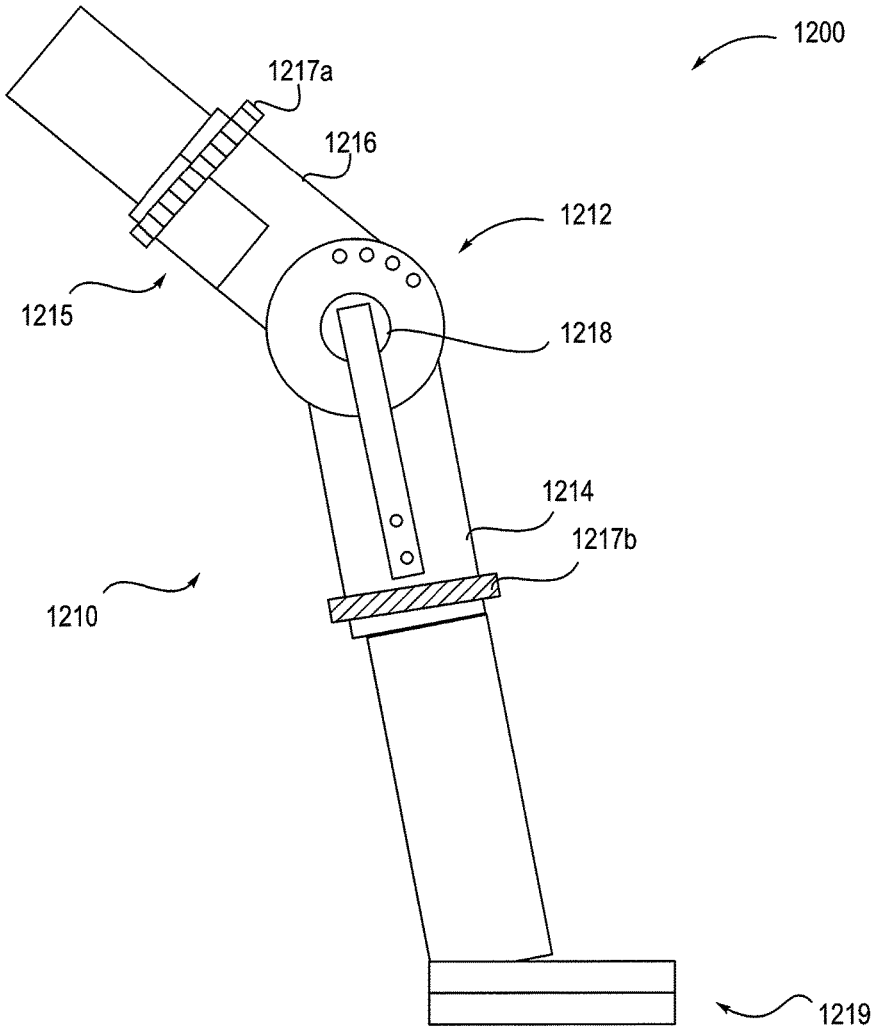
FIG. 12 shows a robotic knee device that can be used in the implementation of the method.

FIG. 12 shows an active muscle support brace 1200 according to an embodiment of the invention that is used to offload some of the stress from the quadriceps when extending the leg. The knee device includes actuator 1212 that imparts a rotary motion to extend or flex the knee. The actuator may be a linear actuator connected to a linkage to convert the linear force to a rotary torque, or may be a rotary actuator such as a geared or high-torque motor. For different parts of the body, other devices are constructed with a suitable shape, but the principles presented here apply by analogy to such devices. The device is particularly useful in helping a subject with muscle weakness in the every day tasks of standing, sitting, walking, climbing stairs and descending stairs. The device can also be used in other modes to help build muscle strength and to monitor movements for later analysis. The support to the muscle is defined by the position of the actuator 1212 applying force to the moving parts of the brace. As the actuator 1212 rotates, and with it the moving (rigid) parts of the brace, the position of the actuator 1212 defines the relative position of the joint and thereby supporting the corresponding muscle.

Structure and Body Attachment

Each device provides assistance and/or resistance to the muscles that extend and flex a joint. The device does not directly connect to the muscle, but is attached in such a way that it can exert external forces to the limbs. Embodiments of the device are built from an underlying structural frame, padding, and straps (not shown) that can be tightened to the desired pressure. The frame structure with hinged lower portion 1214 and upper portion 1216 as shown is preferably made of lightweight aluminum or carbon fiber. In this embodiment, the frame is attached to the upper and lower leg with straps held by Velcro or clip-type connectors 1217*a* and 1217*b*. A soft padding material cushions the leg. The brace may come in several standard sizes, or a custom brace can be constructed by making a mold of the leg and building a brace to precisely fit a replica of the leg constructed from the mold.

The attachment of the device to the body is most easily understood with respect to a specific joint, the knee in this case. The structural frame of the device includes a rigid portion above the knee connected to hinges 1218 at the medial and lateral sides. The rigid structure goes around the knee, typically around the posterior side, to connect both hinges together. On the upper portion of the brace 1216, the rigid portion extends up to the mid-thigh, and on the lower portion 1214, it continues down to the mid-calf. In the thigh and calf regions, the frame extends around from medial to lateral sides around approximately half the circumference of the leg. The remaining portion of the circumference is spanned by straps that can be tightened with clips, laces or Velcro® closures, or any other mechanism of securing the device to the joint that allows easy attachment and removal of the device. The number and width of straps can vary, but the straps must be sufficient to hold the device in place with the axis of rotation of the hinge in approximately the same axis as that of rotation of the knee. The hinge itself may be more complex than a single pivot point to match the rotation of the knee. Cushioning material may be added to improve comfort. A manufacturer may choose to produce several standard sizes, each with enough adjustments to be comfortable for a range of patients, or the manufacturer may use a mold or tracing of the leg to produce individually customized devices.

As explained above in more detail and as depicted in FIG. 8, a microcontroller-based control system drives control information to the actuator, receives user input from a control panel function, and receives sensor information including joint position and external applied forces. Based on the sensor input and desired operation mode, the control system applies forces to resist the muscle, assist the muscle, or to allow the muscle to move the joint freely.

The actuator 1212 is coupled to the brace to provide the force needed to assist or resist the leg muscle(s). Although it is intended to be relatively small in size, the actuator is preferably located to avoid interference with the other leg. The actuator is coupled to both the upper and lower portions of the structural frame to provide assistance and resistance with leg extension and flexion.

The battery compartment may either be integral with actuator or be attached to another part of the structural frame with wires connected to the actuator. Thus, unlike conventional devices this configuration is lighter, more compact, and allows better and easier mobility. The control panel also may either be integral with actuator or be connected to another part of the structural frame with wires connected to the actuator. For devices that include actuators and orthotics for multiple joints, such as for a combination device that rehabilitates both the ankle and the knee, such devices may have a commensurately multiple number of actuators. Buttons of the control panel are preferably of the type that can be operated through clothing to allow the device mode to be changed when the device is hidden under the clothes.

Rotation of the Tibia and Femur

In a preferred implementation, the actuator supplies a rotary torque around a point close to the center of rotation of the knee joint. According to the knee anatomy, in flexion, the tibia lies beneath, and in line with, the midpoint of the patella. As extension occurs, the tibia externally rotates and the tibia tubercle comes to lie lateral to the midpoint of the patella. When the knee is fully flexed, the tibial tubercle points to the inner half of the patella; in the extended knee it is in line with the outer half. The knee anatomy is constructed in such a way that a point on the lower leg does not move exactly in a circular arc. Thus, in order for the circular movement of the actuator to match the movement of the leg, the coupling from the rotor to the lower brace requires either an elastic coupling or a mechanical structure to couple the circular movement of the actuator with the near-circular movement of the portion of the brace attached to the lower leg.

FIGS. 3*a* and 3*b* of U.S. Pat. No. 6,966,882, incorporated herein by this reference, show a coupling mechanism that compensates for the movement of the center of rotation as the knee is flexed. FIG. 3*a* of U.S. Pat. No. 6,966,882 shows the knee flexed at 90 degrees, and FIG. 3*b* of U.S. Pat. No. 6,966,882 shows the knee fully extended. The center of rotation of the actuator is centered at the upper end of the lower leg (tibia) when extended, but shifts towards the posterior of the tibia when the knee is flexed. The sliding mechanism allows the actuator to apply assistance or resistance force at any angle of flexure.

If the center of rotation of the actuator is located a distance away from the joint, other coupling mechanisms can be used to couple the actuator to a portion of the brace on the other side of the joint. The coupling mechanism can be constructed using belts, gears, chains or linkages as is known in the art. These couplings can optionally change the ratio of actuator rotation to joint rotation.

In an alternate implementation using a linear actuator. Any type of linear actuator could be used including the type described in pending U.S. patent application Ser. No. 11/649,493 (published as US-2007-0155560-A1) of Horst entitled "Linear Actuator", incorporated herein by reference.

Terms and Conventions

Unless defined otherwise, all technical terms used herein have the same meanings as commonly understood by one of ordinary skill in the art to which this invention belongs. In particular, other joints such as shoulder, hip, and elbow may also benefit from the rehabilitative methodologies described herein. Specific methods, devices, and materials are described in this application, but any methods and materials similar or equivalent to those described herein can be used in the practice of the present invention. While embodiments of the inventive method have been described in some detail and by way of exemplary illustrations, such illustration is for purposes of clarity of understanding only, and is not intended to be limiting. Various terms have been used in the description to convey an understanding of the invention; it will be understood that the meaning of these various terms extends to common linguistic or grammatical variations or forms thereof. It will also be understood that when terminology referring to devices or equipment has used trade names, brand names, or common names, that these names are provided as contemporary examples, and the invention is not limited by such literal scope. Terminology that is introduced at a later date that may be reasonably understood as a derivative of a contemporary term or designating of a subset of objects embraced by a contemporary term will be understood as having been described by the now contemporary terminology. Further, while some theoretical considerations have been advanced in furtherance of providing an understanding of the invention, for example, of the various ways that embodiments of the invention may engage the physiology of rehabilitation of muscles and neural pathways, the claims to the invention are not bound by such theory. Moreover, any one or more features of any embodiment of the invention can be combined with any one or more other features of any other embodiment of the invention, without departing from the scope of the invention. Still further, it should be understood that the invention is not limited to the embodiments that have been set forth for purposes of exemplification, but is to be defined only by a fair reading of claims that are appended to the patent application, including the full range of equivalency to which each element thereof is entitled.

What is claimed is:

1. A method for extending a subject's controllable range of motion of a joint comprising:

fastening a powered device to the subject at sites above and below the joint of the subject to place the powered device into a therapy position directly adjacent to the joint;

moving the joint volitionally from a starting position to a volitional boundary of extension of the subject's range of motion substantially through an effort of the subject;

moving the joint beyond the volitional boundary of extension towards a predetermined expanded boundary of extension with an extension assistance of the powered device;

without changing the therapy position of the powered device relative to the joint, moving the joint volitionally to a volitional boundary of flexion of the subject's range of motion substantially through an effort of the subject; and moving the joint beyond the volitional boundary of flexion towards a predetermined expanded boundary of flexion with a flexion assistance of the powered device.

2. The method of claim 1 further comprising determining joint angle while the joint is moving volitionally within the subject's range of motion to determine the volitional boundary of extension or flexion of the subject's range of motion.

3. The method of claim 1 wherein moving the joint to the volitional boundary of extension or flexion is repeated one or more times prior to moving the joint beyond the volitional boundary of extension or flexion.

4. The method of claim 1 further comprising setting the predetermined expanded boundary of extension or flexion by an operator entering a value for the predetermined expanded boundary of extension or flexion.

5. The method of claim 1 further comprising setting the predetermined expanded boundary of extension or flexion by applying an algorithm.

6. The method of claim 1 wherein moving the joint to the volitional boundary of extension or flexion occurs without assistance from the powered device.

7. The method of claim 1 wherein moving the joint to the volitional boundary of extension or flexion occurs with an amount of assistance from the powered device that counteracts at least a portion of gravitational force on the joint without exceeding the gravitational force on the joint.

8. The method of claim 1 further includes returning to the starting position, the returning marking a conclusion of a movement cycle, the method further including repeating the movement cycle one or more times.

9. The method of claim 8 wherein returning to the starting position is completed volitionally.

10. The method of claim 8 wherein returning to the starting position is completed with assistance from the powered device.

11. The method of claim 8 wherein returning to the starting position is partially completed volitionally and partially completed with assistance from the powered device.

12. The method of claim 8 wherein the movement cycle is repeated for a predetermined number of times.

13. The method of claim 1 wherein the joint includes any one or more of an ankle, knee, shoulder, hip, elbow, wrist, or finger.

14. A method for increasing a subject's control of movement of a joint within a range of motion comprising:

fastening a powered device to the subject at sites above and below the joint to place the powered device into a therapy position directly adjacent to the joint;

moving the joint volitionally from a starting position toward a volitional boundary of the subject's range of motion substantially through an effort of the subject, the range of motion being toward a goal direction of any of extension or flexion;

permitting movement only in the goal direction with the powered device; and after moving the joint volitionally in the goal direction has stopped, volitionally moving the joint in a direction opposite of the goal direction to return the joint and the powered device to a position within the subject's volitional range of motion without powering the powered device and without changing the therapy position of the powered device and the subject.

15. The method of claim 14 further comprising:

selecting the goal direction;

allowing volitional movements in the goal direction; and disallowing volitional movements away from the goal direction.

16. The method of claim 14 wherein movement toward a volitional boundary is in a first directions of flexion or extension, the method further comprising:

moving the joint volitionally to a volitional boundary in the first direction, and moving the joint back to the starting position;

moving the joint volitionally to a volitional boundary in a second direction opposite to the first direction; and moving the joint to return to the starting position, the return marking a conclusion of a movement cycle.

17. The method of claim 16 further comprising repeating the movement cycle one or more times.

18. The method of claim 14 wherein the joint includes any one or more of an ankle, a knee, a shoulder, a hip, an elbow, a wrist, or a finger.

19. A method for improving a subject's ability to volitionally control movement of a joint of the subject comprising:

fastening a powered device at sites above and below the joint of the subject to place the powered device into a therapy position directly adjacent to the joint;

moving the joint volitionally within a volitional range of motion substantially without assistance of the powered device;

moving the joint beyond a volitional boundary of the subject's volitional range of motion substantially with support of the powered device to a position within a rehabilitative range of motion; and thereafter, moving the joint volitionally substantially without assistance of the powered device from the position within the rehabilitative range of motion to place both the joint and the powered device within the subject's volitional range of motion while maintaining the same therapy position of the powered device to the subject used during the step of moving the joint beyond the volitional boundary of the subject's volitional range of motion.

20. The method of claim 19 wherein moving the joint volitionally within the volitional range of motion substantially without assistance of the powered device includes moving the joint from a starting position to a volitional boundary of the subject's volitional range of motion; and wherein moving the joint with the support of the powered device includes moving the joint beyond the volitional boundary with assistance of the powered device.

21. The method of claim 19 wherein moving the joint volitionally within the volitional range of motion substantially without assistance of the powered device includes moving the joint solely through an effort of the subject.

22. The method of claim 19 wherein moving the joint volitionally within the volitional range of motion substantially without assistance of the powered device includes moving the joint with assistance from the powered device by providing an assistance amount sufficient to partially counteract an effect of gravitational force on the joint.

23. The method of claim 19 wherein moving the joint volitionally includes moving the joint from a starting position in a direction toward the volitional boundary of the volitional range of motion; and wherein moving the joint with the support of the powered device includes permitting only movement in the direction.

* * * * *